US005413887A

United States Patent [19]

Ueda

[11] Patent Number: 5,413,887

[45] Date of Patent: May 9, 1995

[54] DISTYRYL COMPOUND AND PHOTOSENSITIVE MEMBER COMPRISING THE SAME

[75] Inventor: Hideaki Ueda, Kawanishi, Japan

[73] Assignee: Minolta Camera Kabushiki Kaisha, Osaka, Japan

[21] Appl. No.: 962,093

[22] Filed: Oct. 16, 1992

[30] Foreign Application Priority Data

Oct. 17, 1991 [JP] Japan ..... 3-269282
Oct. 23, 1991 [JP] Japan ..... 3-275351
Oct. 12, 1992 [JP] Japan ..... 4-272798

[51] Int. Cl.[6] ..... G03G 5/047; G03G 5/09

[52] U.S. Cl. ..... 430/58; 430/59; 430/83

[58] Field of Search ..... 430/58, 59, 83

[56] References Cited

U.S. PATENT DOCUMENTS 4,971,874 11/1990 Ueda ..... 430/58
5,077,162 12/1991 Ueda ..... 430/59
5,079,119 1/1992 Suzuki et al. ..... 430/59
5,166,019 11/1992 Ueda et al. ..... 430/58

FOREIGN PATENT DOCUMENTS 30853 2/1988 Japan ..... 430/58
189872 8/1988 Japan ..... 430/59
2-56559 2/1990 Japan .

*Primary Examiner*—Roland Martin
*Attorney, Agent, or Firm*—Burns, Doane, Swecker & Mathis

[57] ABSTRACT

The present invention provides a new distyryl compound represented by the following general formula [I] or [II].

[I]

[II]

The present invention provides a photosensitive member and an electroluminescence device both of which comprise the distyryl compound of the general formula [I] or [II] as a charge transporting material.

13 Claims, 5 Drawing Sheets

DISTYRYL COMPOUND AND PHOTOSENSITIVE MEMBER COMPRISING THE SAME

BACKGROUND OF THE INVENTION

The present invention relates to a new compound with a distyryl structure. The distyryl compound is used as a photosensitive material. In particular, the distyryl compound can be applied to a photosensitive member or an electroluminescence device as a charge transporting material.

Many organic compounds such as anthracenes, anthraquinones, imidazoles, carbazoles and styryl derivatives, which can be used as a photosensitive material or a charge transporting material, have been known.

However, when the materials described above are applied, for example, to a photosensitive member, the compatibility with other members, durability and weathering resistance are required basically as well as good photosensitivity and good charge transportability. The fact is that there are few materials meeting such characteristics as above mentioned.

SUMMARY OF THE INVENTION

The object of the present invention is to provide a new distyryl compound.

Another object of the present invention is to provide a photosensitive member containing the new distyryl compound.

Another object of the present invention is to provide an electroluminescence device having a charge transporting layer composed of the new distyryl compound.

The present invention relates to a distyryl compound represented by the following general formulas [I] or [II]:

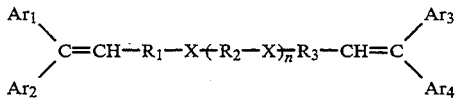

[I]

in which $Ar_1$, $Ar_2$, $Ar_3$ and $Ar_4$ represent respectively a hydrogen atom, an alkyl group, an aralkyl group, an aryl group, a biphenyl group or a heterocyclic group, each group may have a substituent;

$R_1$, $R_2$ and $R_3$ represent respectively an aralkylene group, an arylene group, a biphenylene group or a bivalent heterocyclic group, each of which may have a substituent;

X represents —O—, —S— or

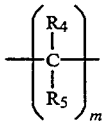

in which $R_4$ and $R_5$ represent respectively a hydrogen atom, an alkyl group or an aryl group; each group may have a substituent;

n is an integer of 0 or 1;

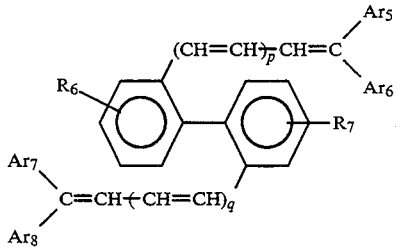

[II]

in which $Ar_5$ and $Ar_7$ represent respectively a hydrogen atom, an alkyl group or an aryl group which may have a substituent;

$Ar_6$ and $Ar_8$ represent respectively an aryl group, a fused ring group or a heterocyclic group, each of which may have a substituent;

$R_6$ and $R_7$ represent respectively a hydrogen atom, an alkyl group, an alkoxy group or a halogen atom;

p and q represent respectively an integer of 0 or 1.

The distyryl compound is applied to a photosensitive member or an electroluminescence device.

DETAILED DESCRIPTION OF THE INVENTION

Figure 1:
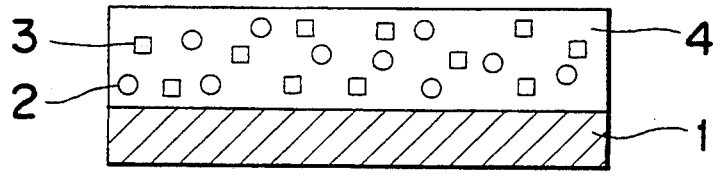
FIG. 1 is a schematic sectional view of a dispersion-type photosensitive member having a photosensitive layer on an electrically conductive substrate.

The present invention relates to a distyryl compound represented by the following general formula [I] or [II].

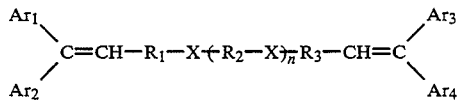

[I]

-continued

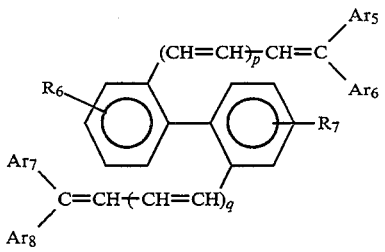

[II]

First the styryl compound represented by the general formula [I] is explained.

In the general formula [I], $Ar_1$, $Ar_2$, $Ar_3$ and $Ar_4$ represent respectively an alkyl group such as methyl, ethyl and propyl, an aralkyl group such as benzyl and phenethyl, an aryl group such as phenyl and naphthyl, a biphenyl group or a heterocyclic group shown below:

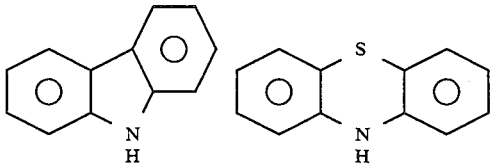

-continued

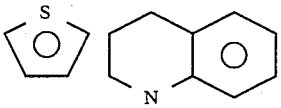

These groups above mentioned may have a substituent such as an alkyl group (methyl, ethyl, propyl, butyl etc.), an alkoxy group (methoxy etc.) or a disubstituted amino group. A phenyl group or a heterocyclic group is preferable.

$R_1$, $R_2$ and $R_3$ represent respectively an aralkylene group (benzylene etc.), an arylene group (phenylene etc.), a biphenylene group and a bivalent heterocyclic group (thienylene etc.). These groups may have a substituent, for example an alkyl group such as methyl, ethyl and propyl, an alkoxy group such as methoxy, ethoxy and propoxy or a halogen atom such as fluorine atom, chlorine atom and bromine atom. An alkyl group is preferable from the view point of its compatibility with resin.

x represents —O—, —S— or

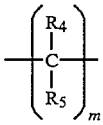

in which $R_4$ and $R_5$ represent respectively a hydrogen atom, an alkyl group such as methyl, ethyl and propyl or an aryl group such as phenyl and naphthyl.

m represents an integer of 1–5.

n in the formula [I] is an integer 0 or 1.

Concrete compounds having the distyryl structure represented by the general formula [I] are exemplified as shown below:

[I-1]
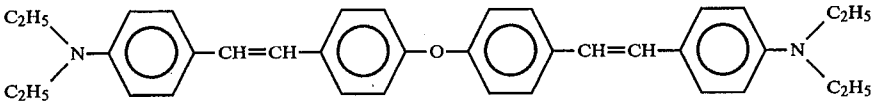
[I-2]
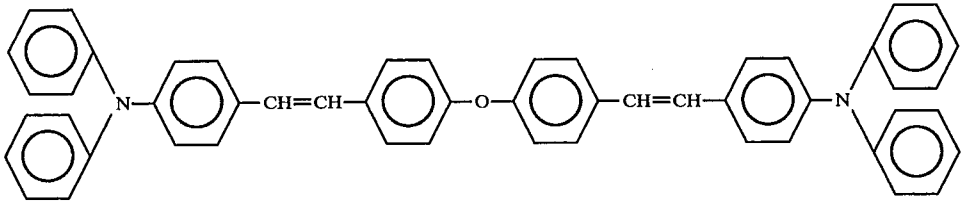
[I-3]
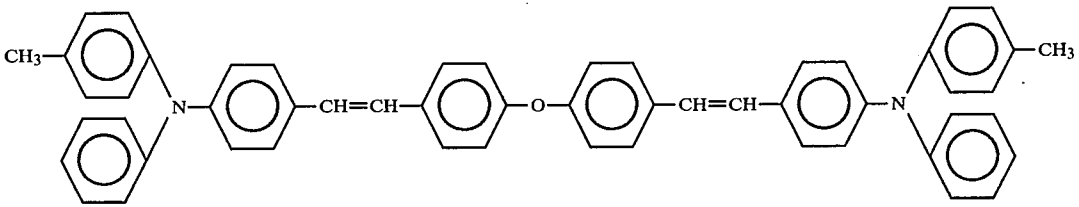
[I-4]
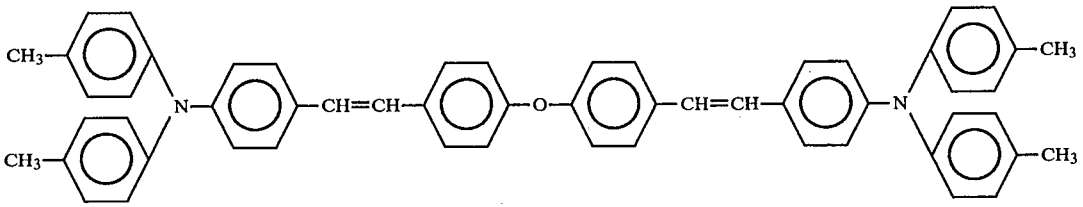
[I-5]
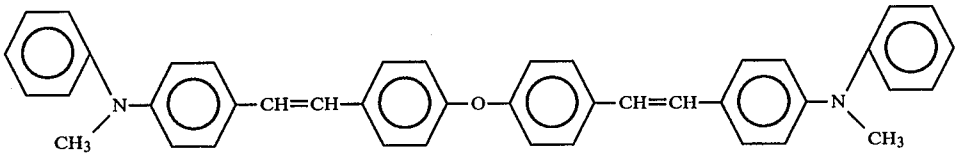

-continued
[I-6]
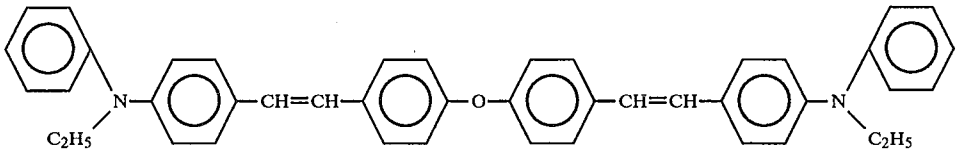
[I-7]
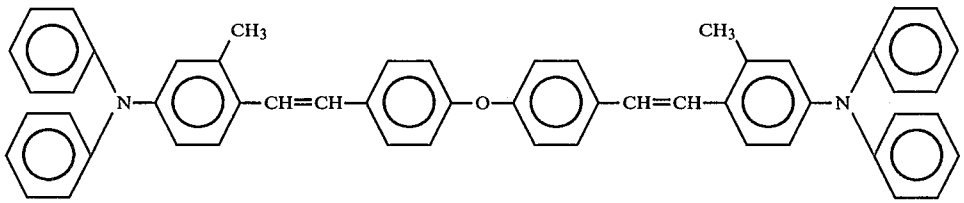
[I-8]
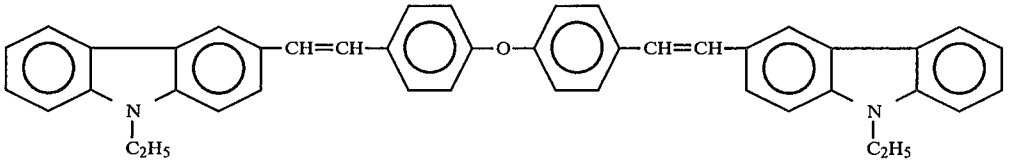
[I-9]
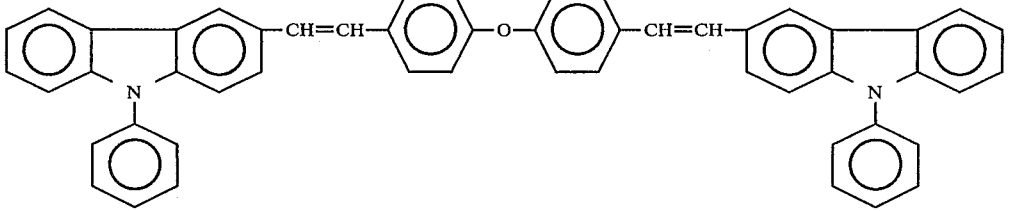

-continued
[I-10]
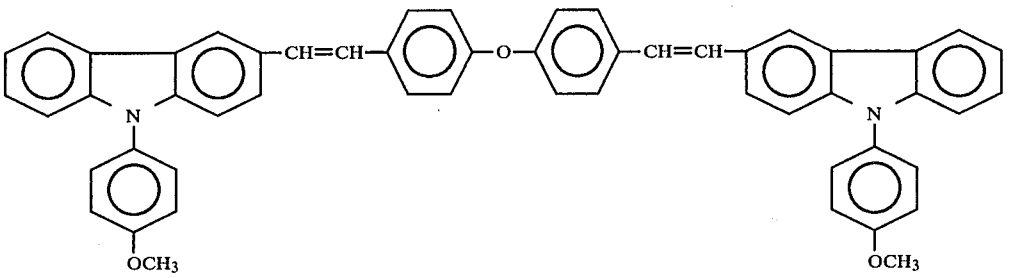
[I-11]
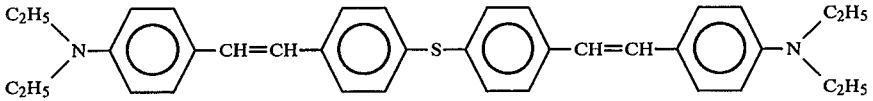
[I-12]
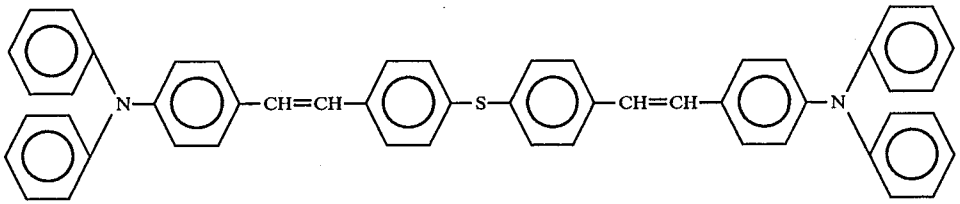
[I-13]
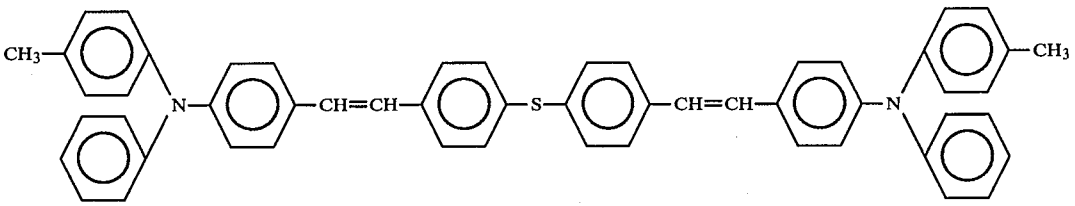
[I-14]
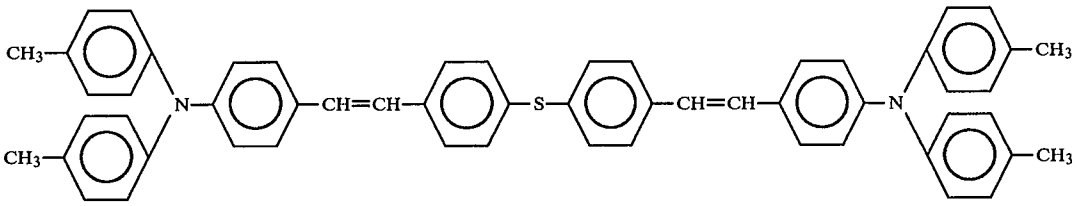

-continued
[I-15]
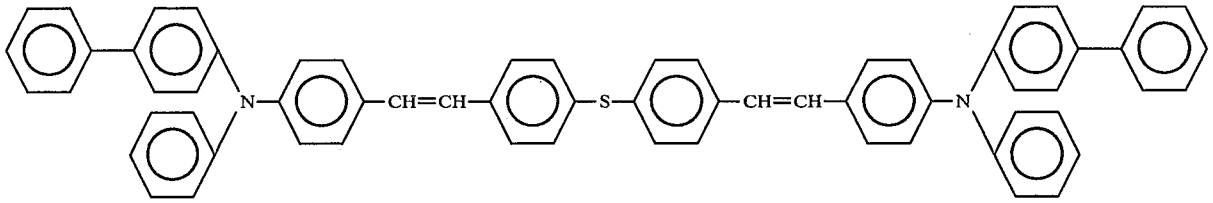
[I-16]
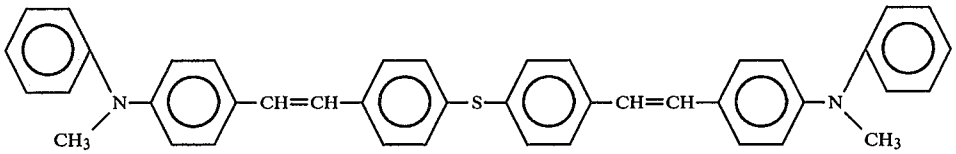
[I-17]
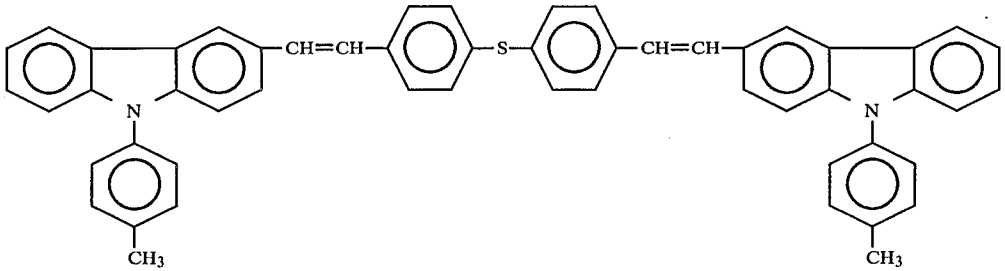
[I-18]
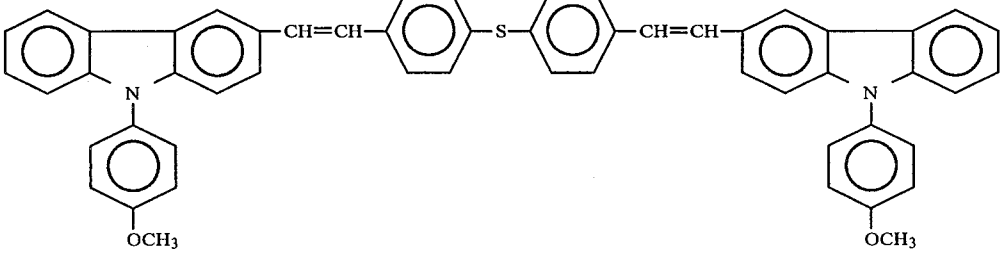

-continued
[I-19]
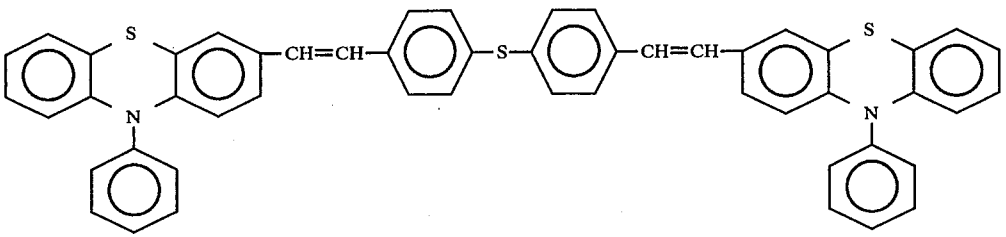
[I-20]
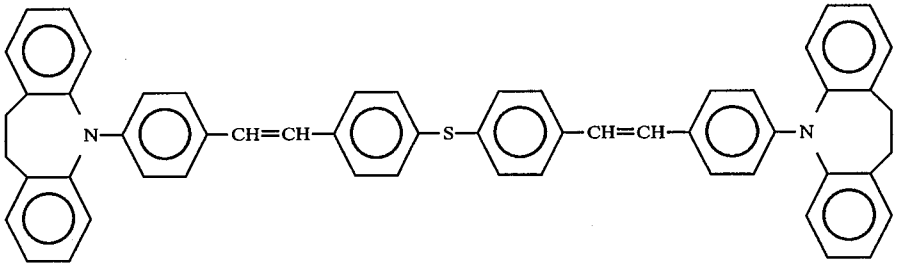
[I-21]
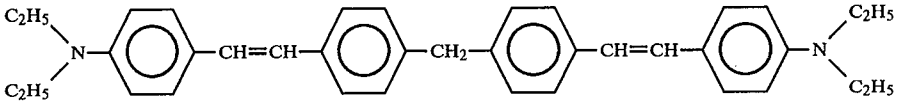
[I-22]
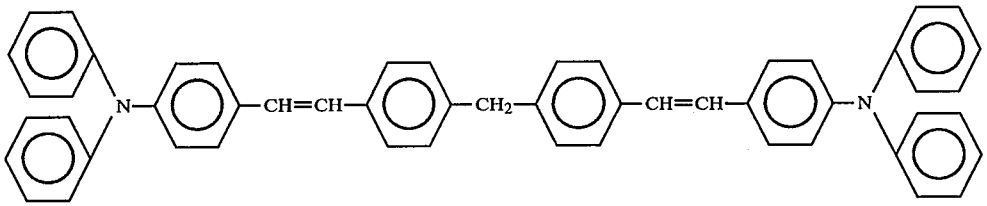
[I-23]
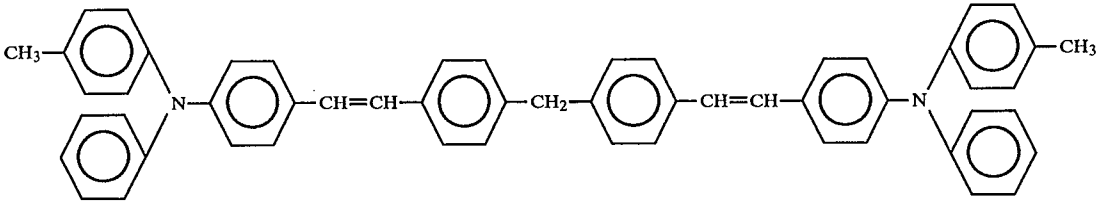

-continued
[I-24]
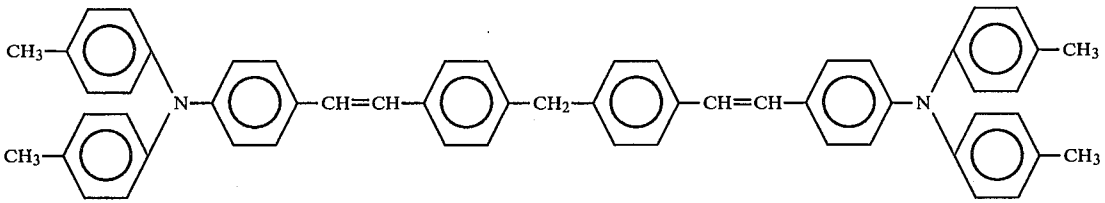
[I-25]
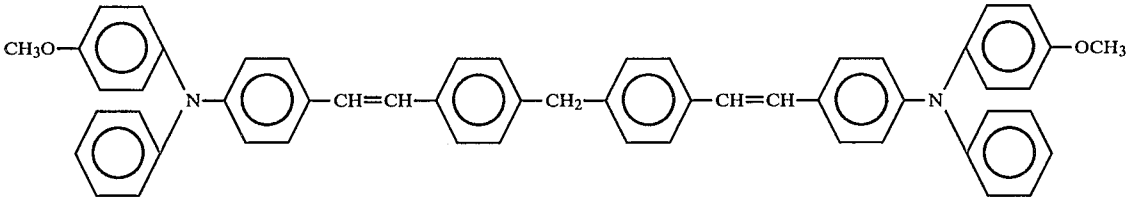
[I-26]
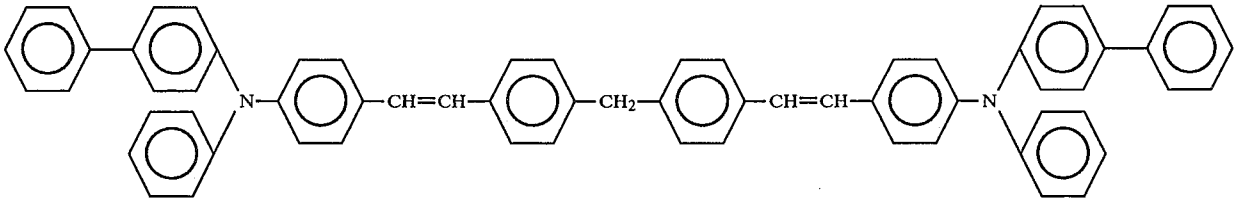
[I-27]
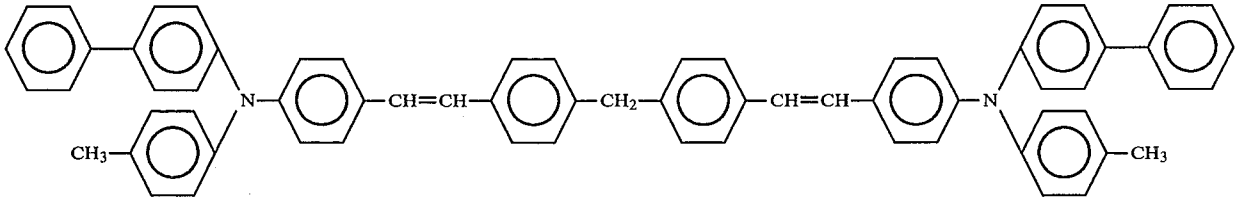

-continued
[I-28]
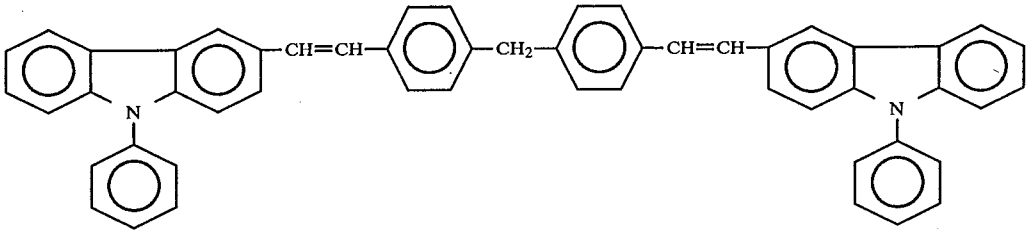
[I-29]
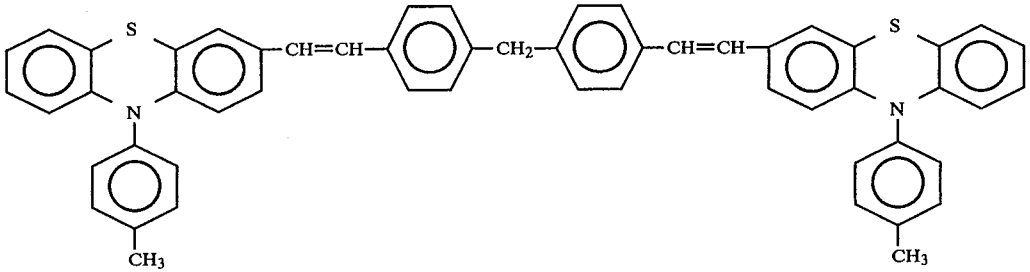
[I-30]
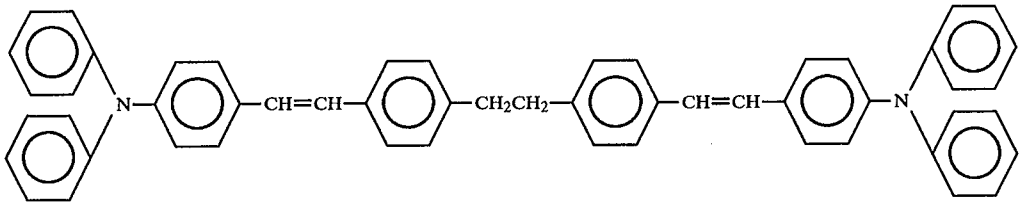
[I-31]
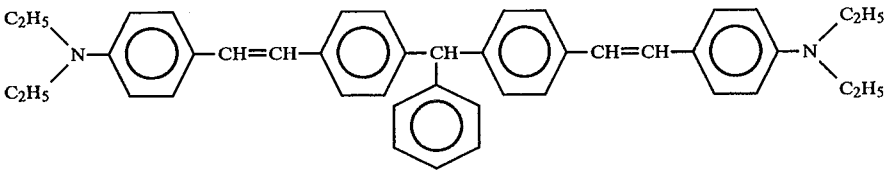

-continued
[I-32]
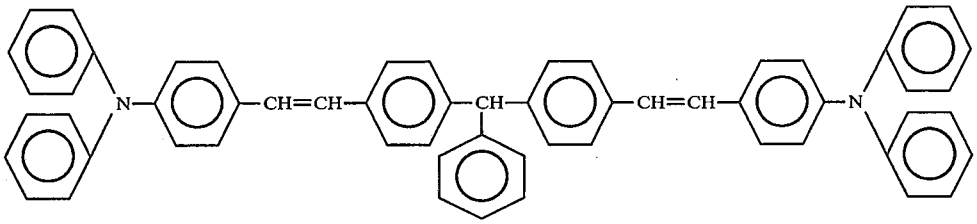
[I-33]
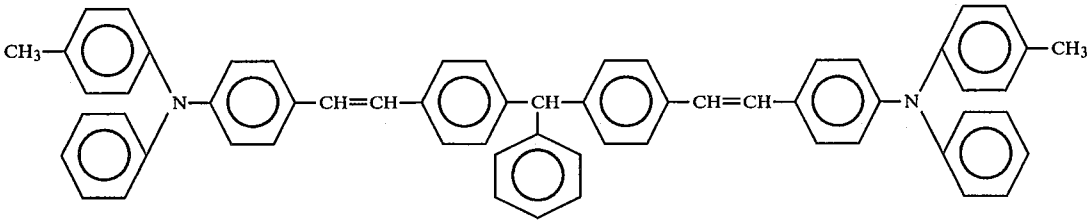
[I-34]
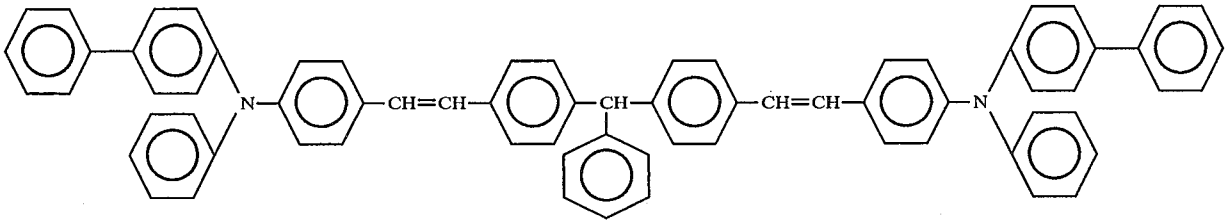
[I-35]
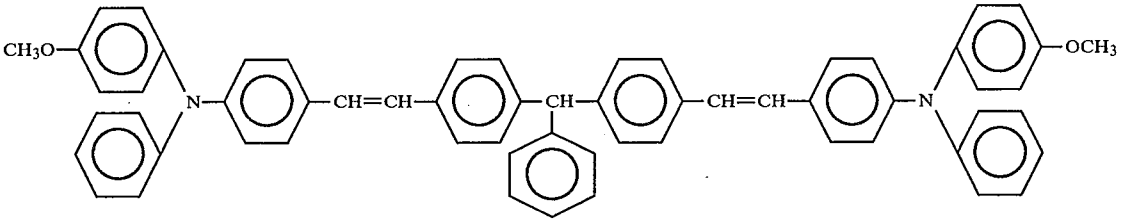

-continued
[I-36]
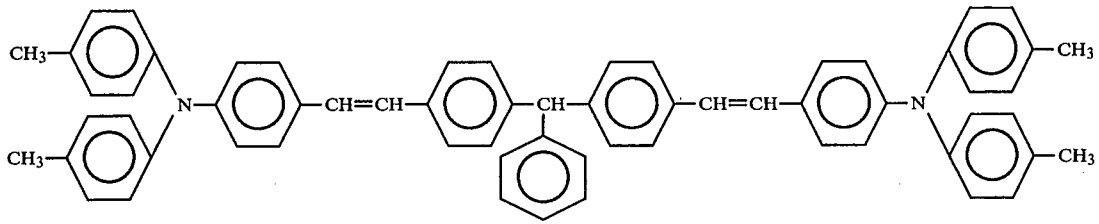
[I-37]
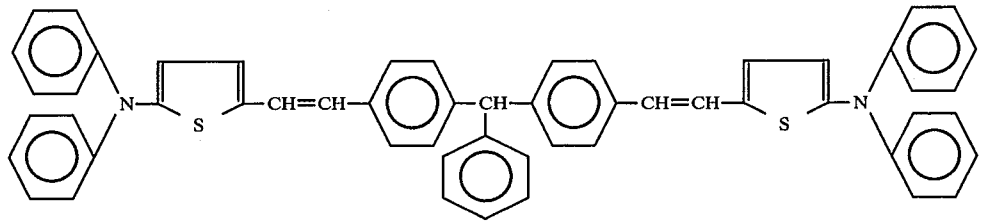
[I-38]
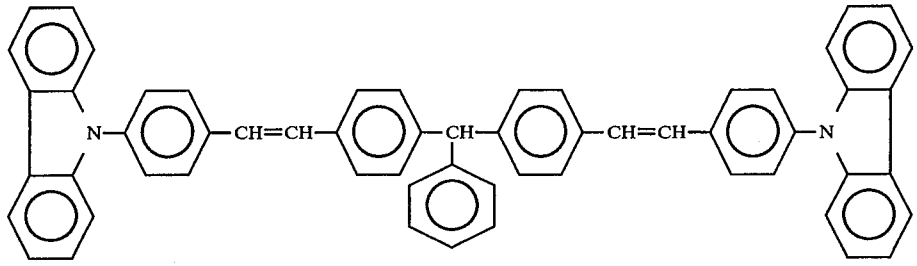
[I-39]
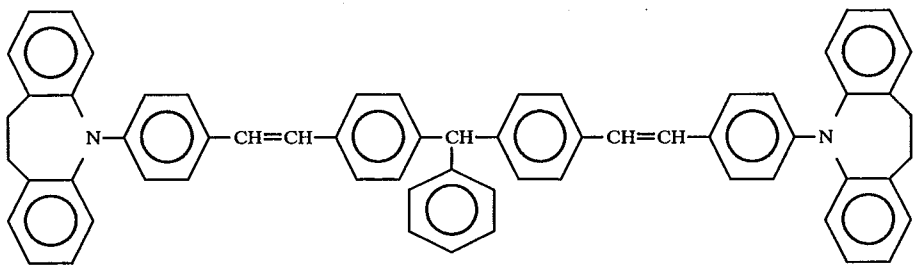

-continued
[I-40]
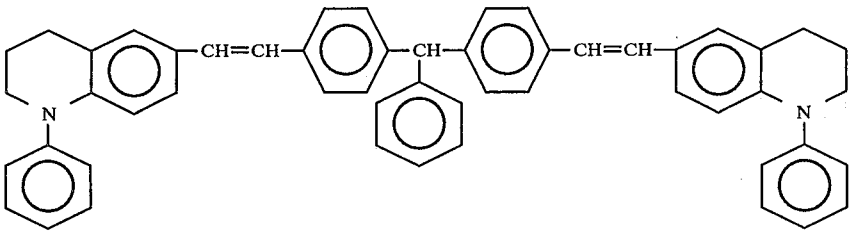
[I-41]
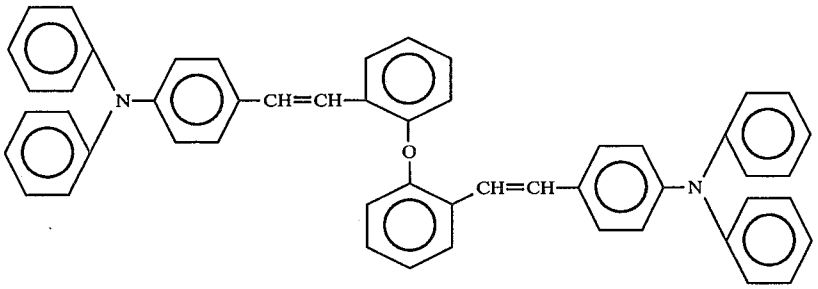
[I-42]
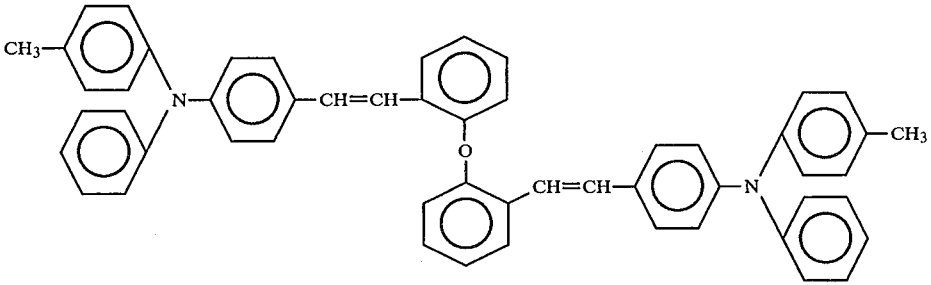

-continued
[I-43]
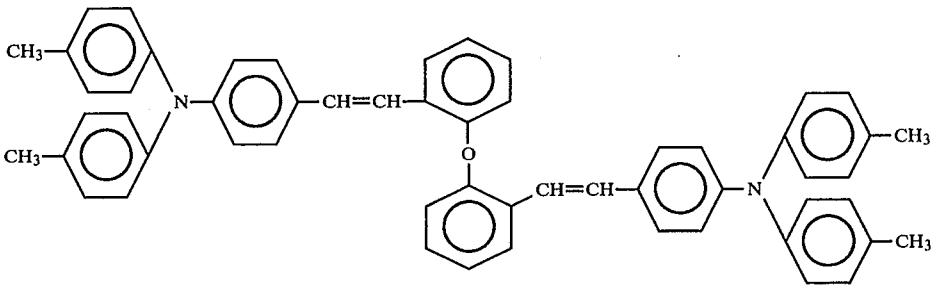
[I-44]
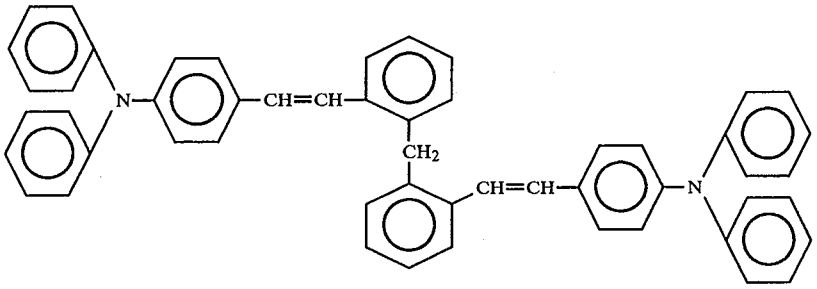
[I-45]
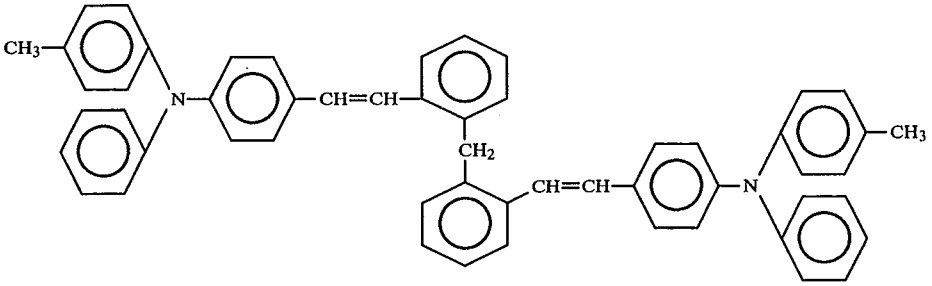

-continued
[I-46]
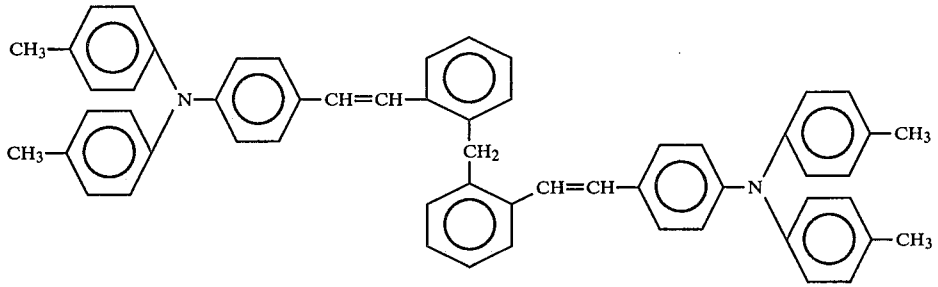
[I-47]
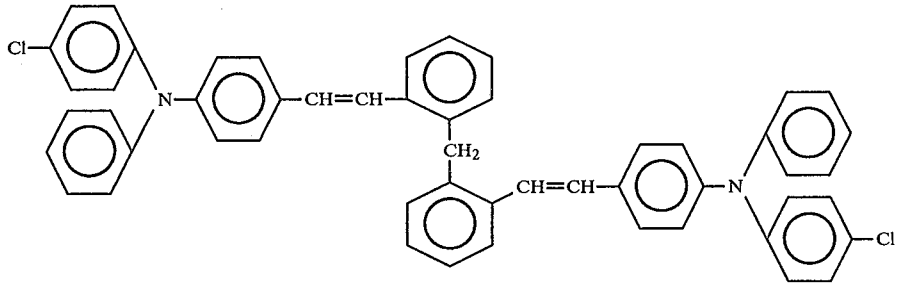
[I-48]
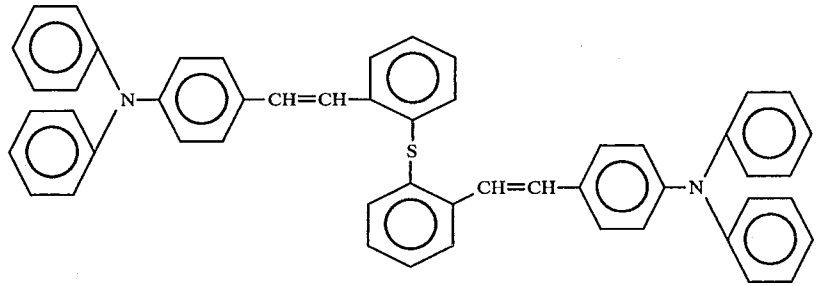

-continued
[I-49]
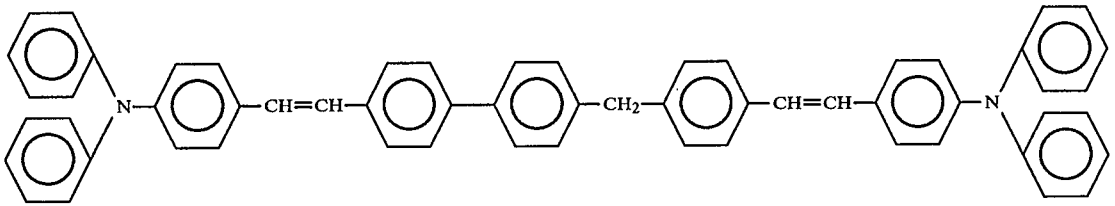
[I-50]
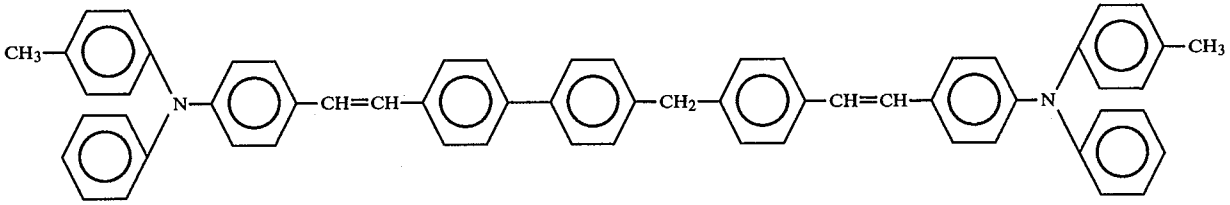
[I-51]
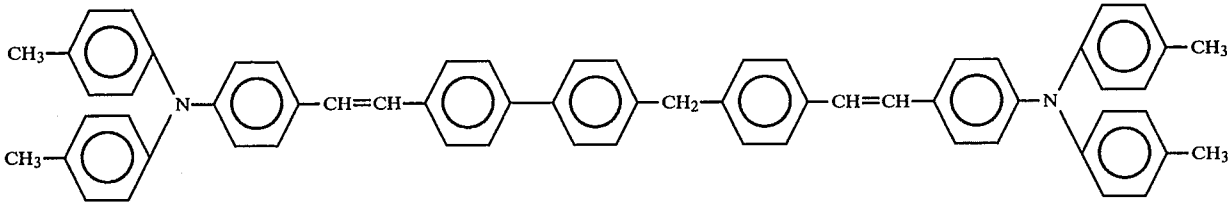
[I-52]
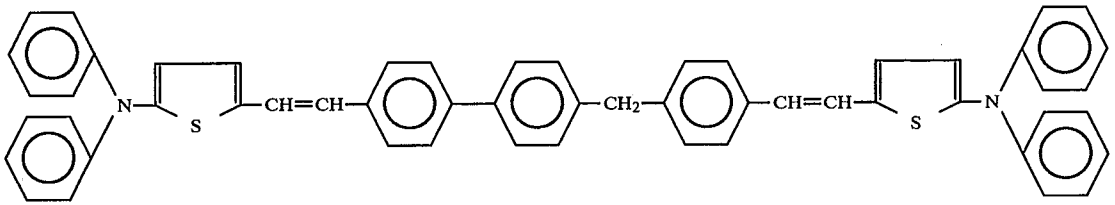
[I-53]
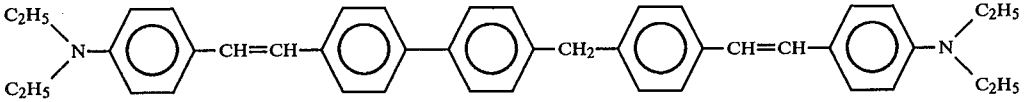

-continued
[I-54]
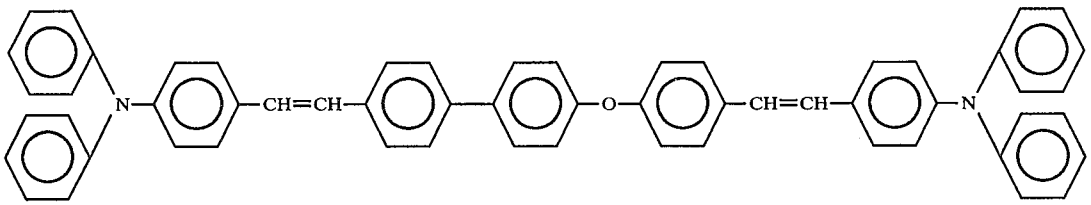
[I-55]
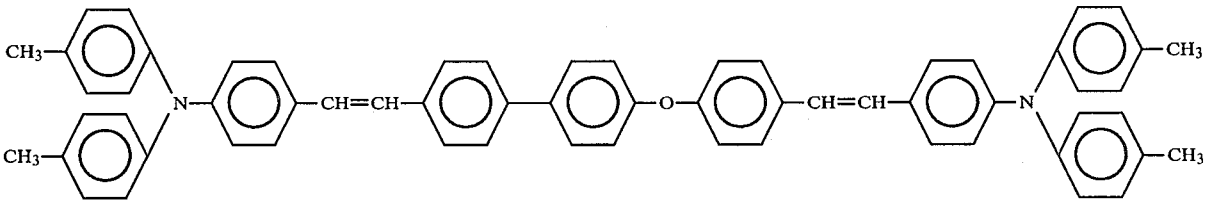
[I-56]
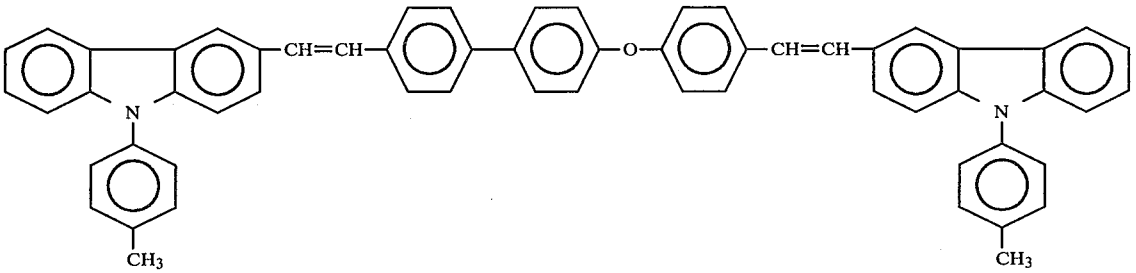
[I-57]
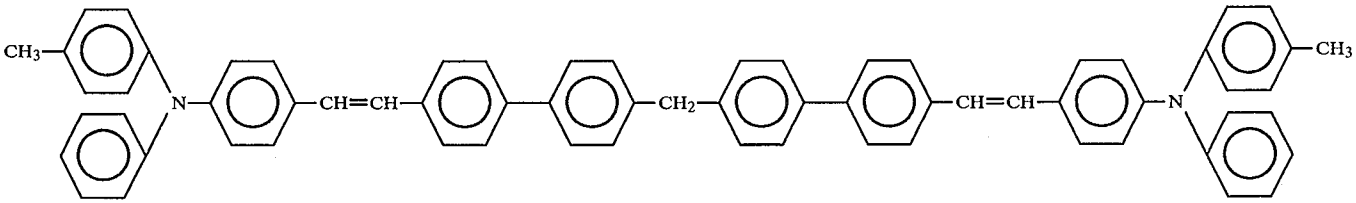

-continued
[I-58]
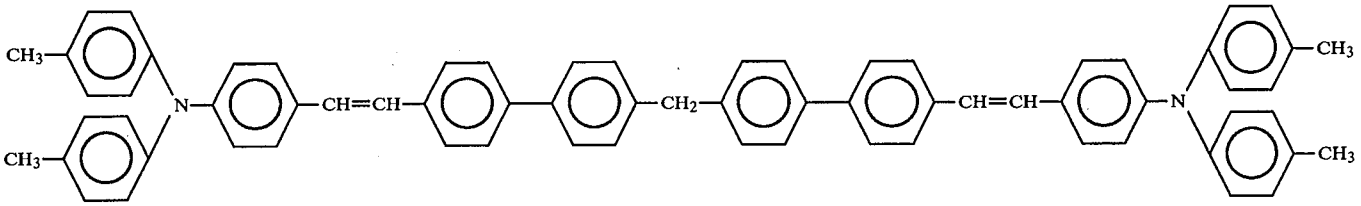
[I-59]
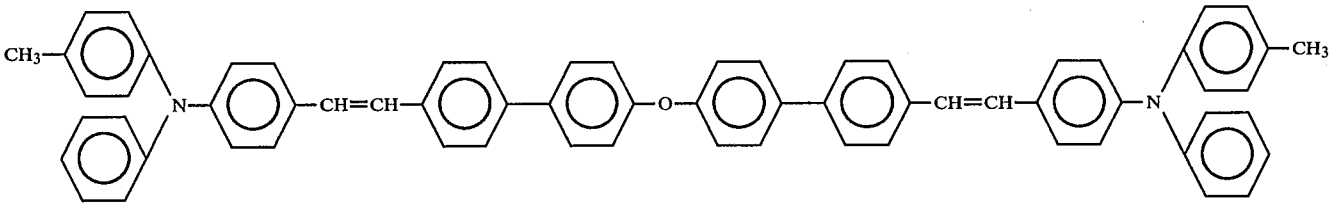
[I-60]
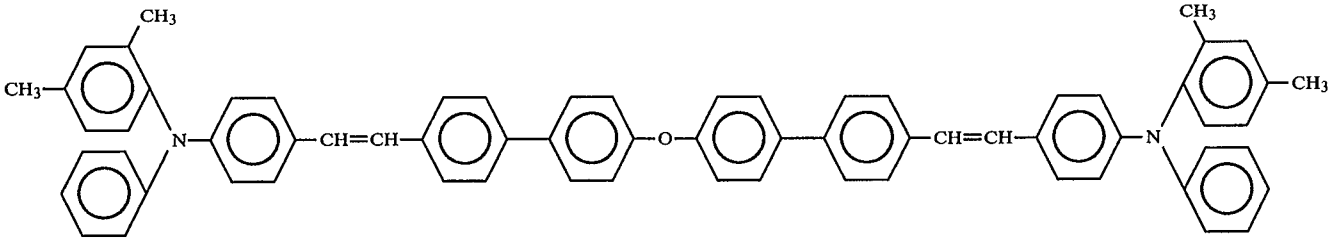
[I-61]
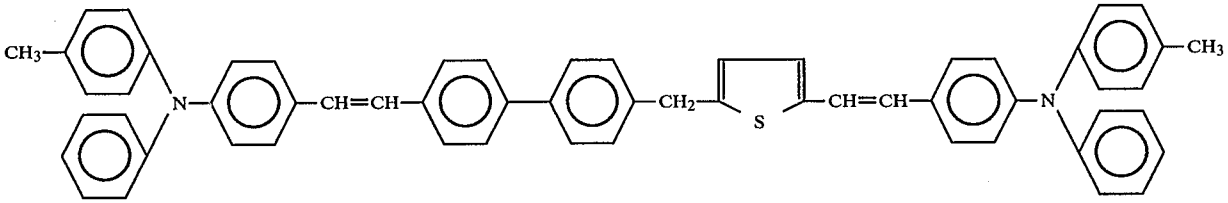

-continued
[I-62]
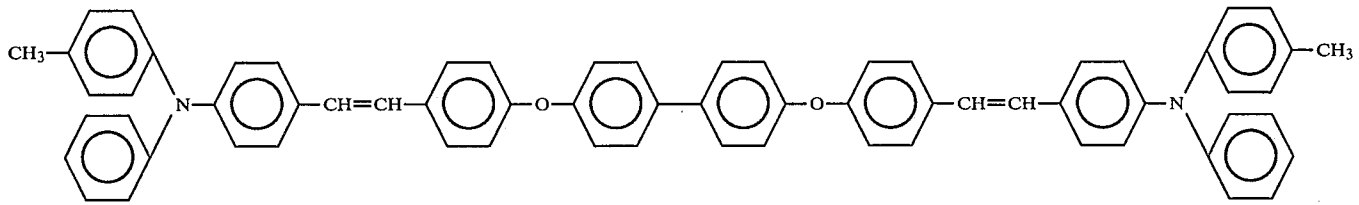
[I-63]
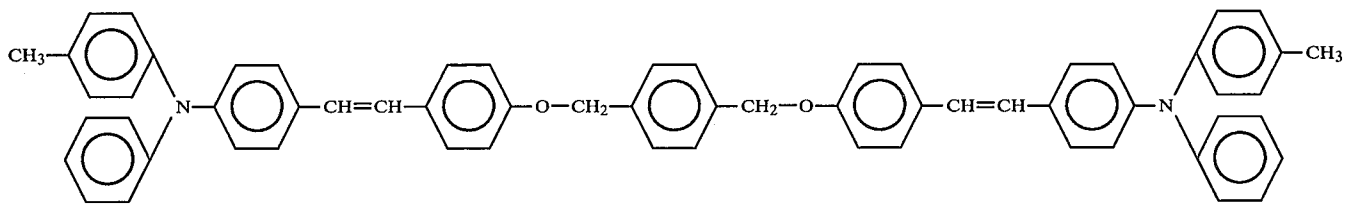

Among those compounds, [I-2], [I-3], [I-4], [I-5], [I-7], [I-8], [I-9], [I-10], [I-12], [I-13], [I-14], [I-15], [I-19], [I-20], [I-23], [I-24], [I-25], [I-30], [I-33], [I 34], [I-35], [I-41], [I-42], [I-43], [I-44], [I-45], [I-46], [I-47], [I-48], [I-49], [I-50], [I-51], [I-52], [I-54], [I -55], [I-57], [I-58], [I-59], [I-60]and [I-63] are particularly preferred.

A distyryl compound represented by the general formula [I] can be prepared as follows;

For example, a phosphorus compound represented by the following formula [III]:

$$YCH_2-R_1-X\text{-}(R_2-X)_n R_3-CH_2Y \quad [III]$$

in which X, $R_1$ to $R_3$ and n are the same as those in the formula [I]; Y is trialkyl or triaryl phosphonium salt represented by $-P^+(R_8)_3Z^-$ (Z represents a halogen atom; $R_8$ represents an alkyl group or an aryl group), or dialkyl or diaryl phosphite salt represented by $PO(OR_9)_2$ ($R_9$ is an alkyl group or an aryl group),
is treated for condensation with ketone compounds represented by the following general formulas [IV] and [V]:

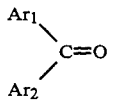
[IV]

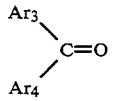
[V]

in which $Ar_1$ to $Ar_4$ are the same as those in the formula [I].

This synthesis method is particularly suitable for a distyryl compound represented by the general formula [I] in which n is zero.

The compound represented by the general formula [III] can be synthesized by treating a compound represented by the following formula [VI]:

$$ACH_2-R_1-X\text{-}(R_2-X)_n R_3-CH_2A \quad [VI]$$

in which A is a halogen atom, with triaryl phosphine or trialkyl phosphite.

The compound represented by the general formula [VII] can be synthesized by treating a compound represented by the following formula [VII]:

$$R_1-X\text{-}(R_2-X)_n R_3 \quad [VII]$$

with a halogenation methylation agent for condensation in the presence of a catalyst such as zinc chloride.

The compound represented by the general formula [VI] can be also synthesized by treating a compound represented by the following formula [VIII]:

$$HOCH_2-R_1-X\text{-}(R_2-X)_n R_3-CH_2OH \quad [VIII]$$

with a halogenation agent such as thionyl chloride for halogenation.

A solvent used in the above reaction is exemplified by hydrocarbons, alcohols and ethers, in particular, methanol, ethanol, isopropyl alcohol, butanol, 2-methoxyethanol, 1,2-dimethoxyethane, bis(2-methoxyethyl) ether, dioxane, tetrahydrofuran, toluene, xylene, dimethylsulfoxide, N,N-dimethylformamide, N-methylpyrrolidone or 1,3-dimethyl-2-imidazolidinone. Among these solvents a polar solvent such as N,N-dimethylformamide and dimethylsulfoxide are particularly preferred.

A condensation agent is exemplified by sodium hydroxide, potassium hydroxide, sodium amide, hydrogen sodium and a alcoholate such as sodium methoxide, potassium t-butoxide.

The reaction may be carried out in a wide range of temperature between about 0° C. to about 100° C., preferably about 10° C. to about 80° C.

Another synthesis method of the distyryl compound represented by the formula [I] is as follows;

An aldehyde compound represented by the following general formula [IX]:

$$OHC-R_1-X\text{-}(R_2-X)_n R_3-CHO \quad [IX]$$

in which X, $R_1$ to $R_3$ and n are the same as those in the formula [I],
is treated for condensation with Wittig agents represent by the following general formulas [IX] and [XI]:

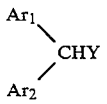
[X]

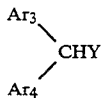
[XI]

in which $Ar_1$ to $Ar_4$ are the same as those in the formula [I]; Y is the same as those in the formula [III].

Then the styryl compound represented by the general formula [II] is explained hereinafter.

In the general formula [II], $Ar_5$ and $Ar_7$ represent respectively a hydrogen atom, an alkyl group such as methyl, ethyl and propyl or an aryl group such as phenyl. The aryl group may have a substituent such as disubstituted amino group, a heterocylclic group and a aryl group.

$Ar_6$ and $Ar_8$ represent respectively an aryl group such as phenyl and naphthyl, a fused ring group such as anthracene, pyrene and fluorene or a heterocyclic group such as the ones below:

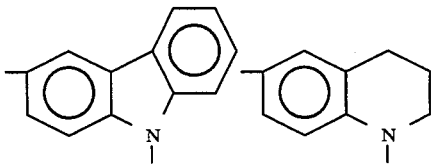

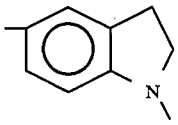

These group above may have a substituent such as a disubstituted amino group and a heterocyclic group. At least one of $Ar_6$ and $Ar_8$ is preferably an aryl group.

$R_6$ and $R_7$ represent respectively a hydrogen atom, an alkyl group such as methyl, ethyl and propyl, an alkoxy group and methoxy, ethoxy and propoxy or a halogen atom such as fluorine, chlorine and bromine. An alkyl group is preferable from the view point of its compatibility with resin.

p and q represent respectively an integer of 0 or 1.

Concrete compounds having the distyryl structure represented by the general formula [II] are exemplified as shown below:

[II-1]

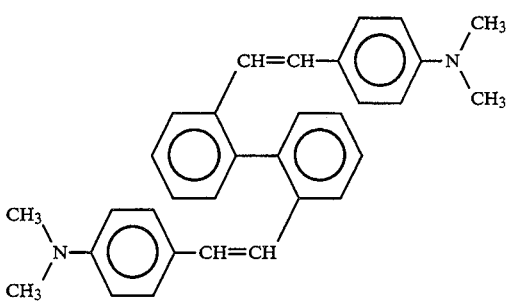

[II-2]

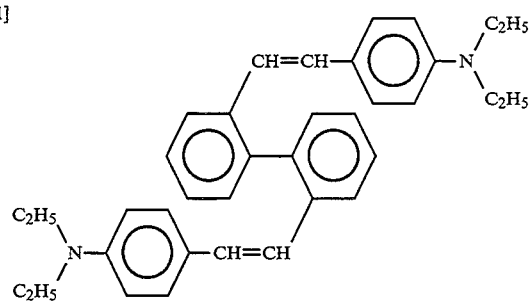

[II-3]

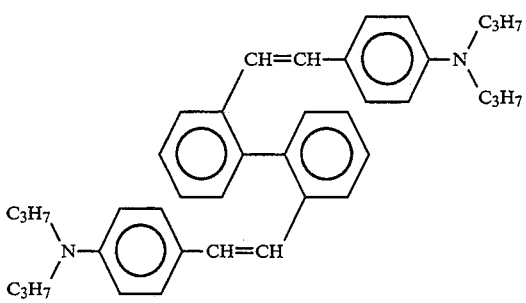

[II-4]

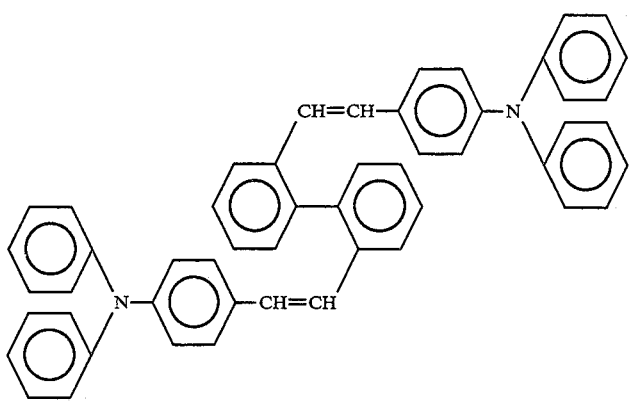

[II-5]

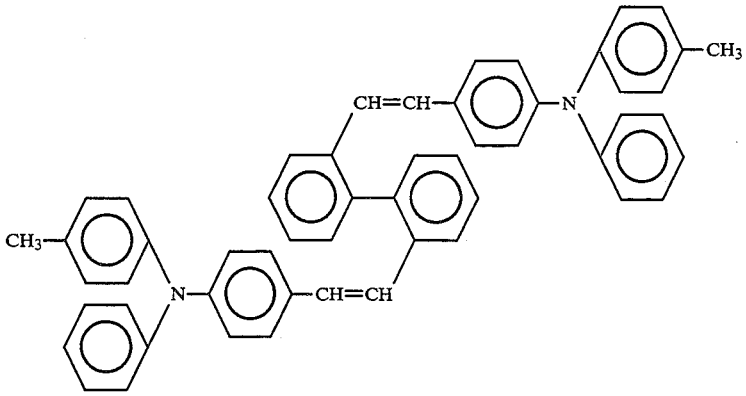

-continued
[II-6]
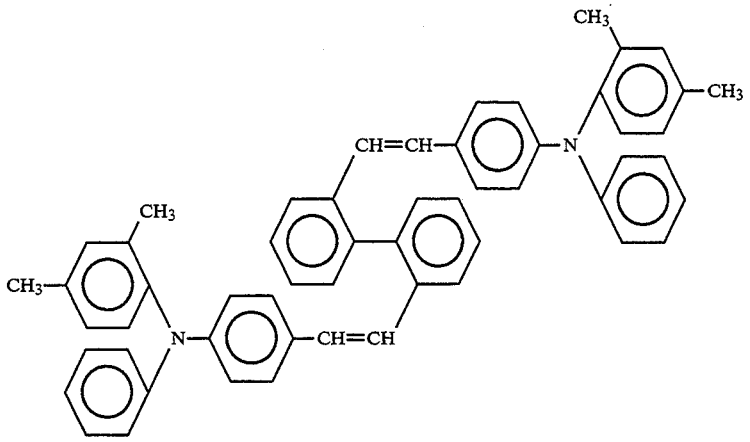
[II-7]
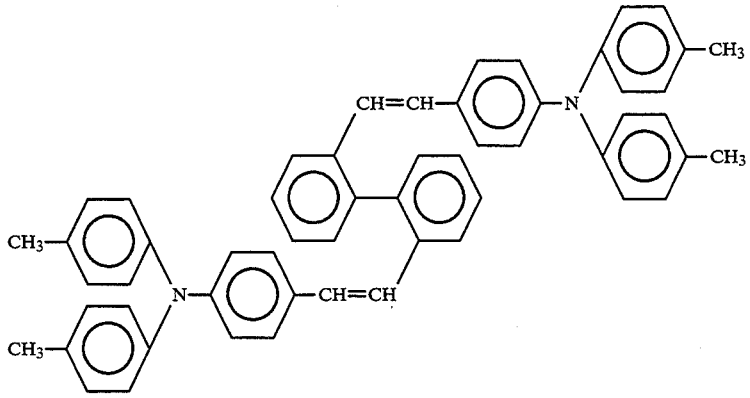
[II-8]
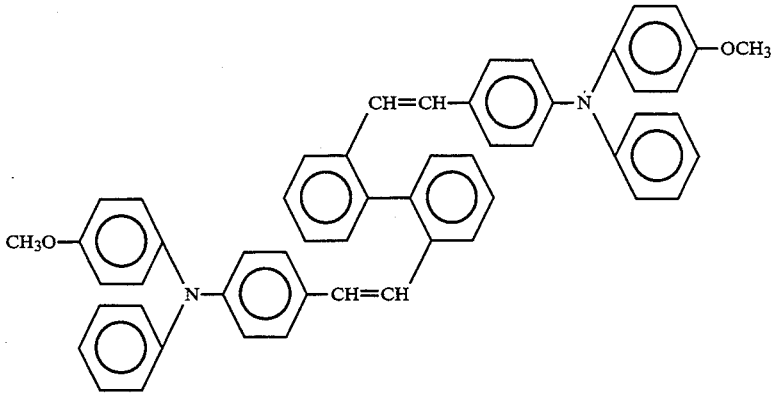
[II-9]
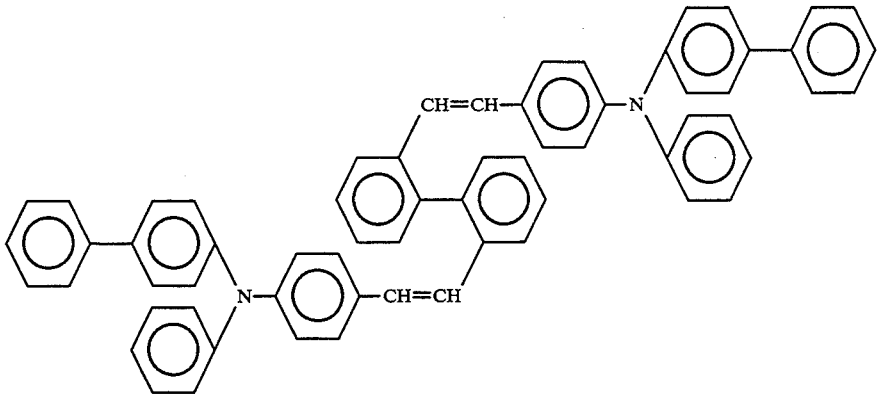

-continued
[II-10]
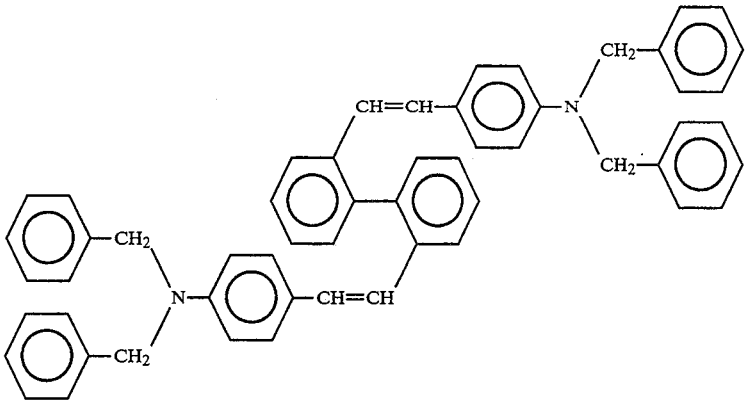
[II-11]
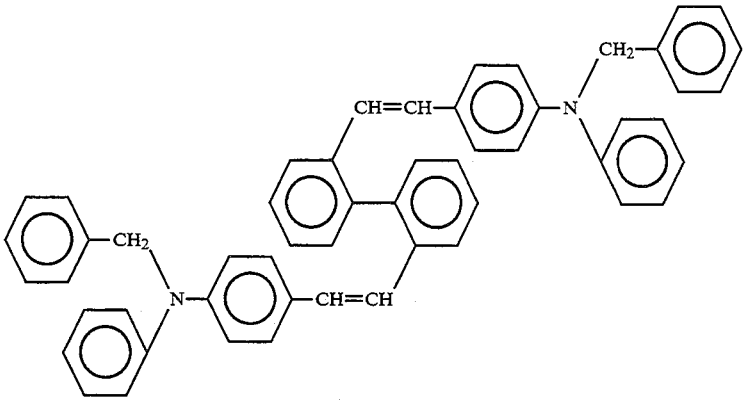
[II-12]
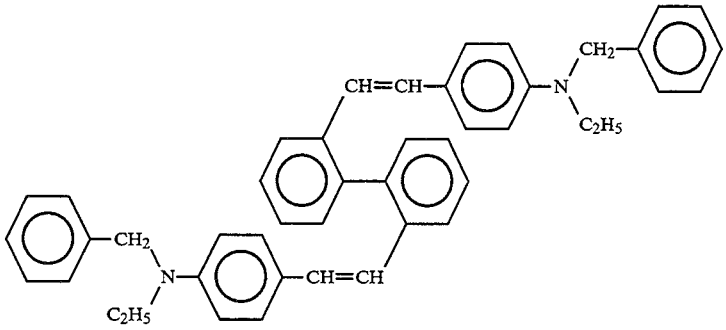
[II-13]
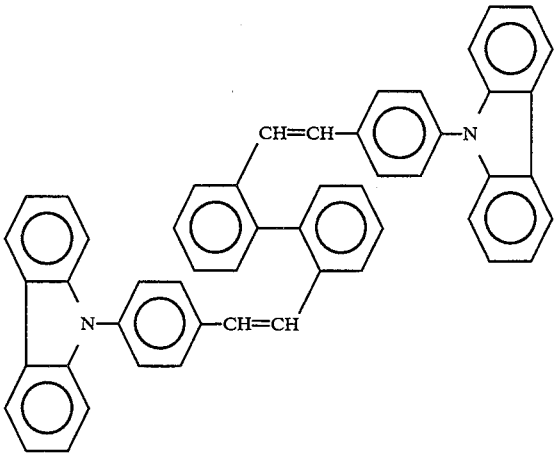
[II-14]
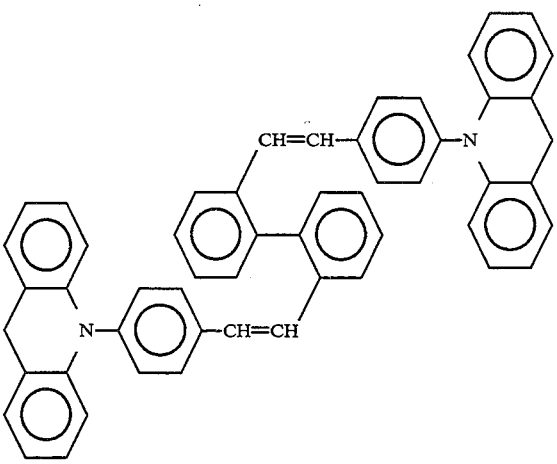

-continued
[II-15]
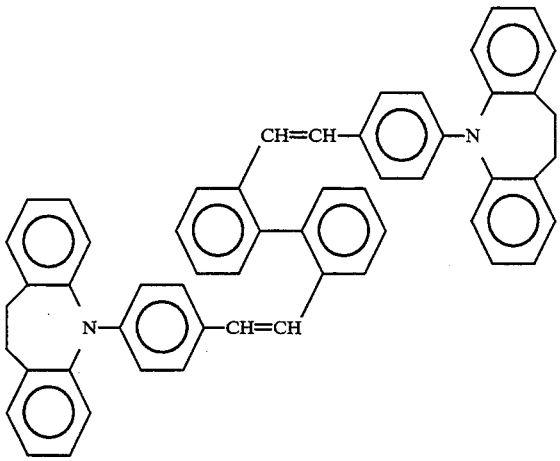
[II-16]
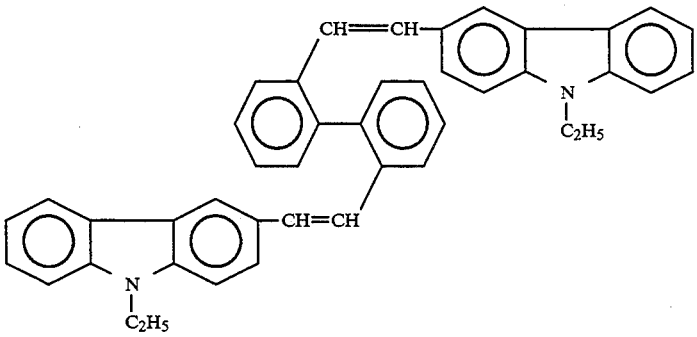
[II-17]
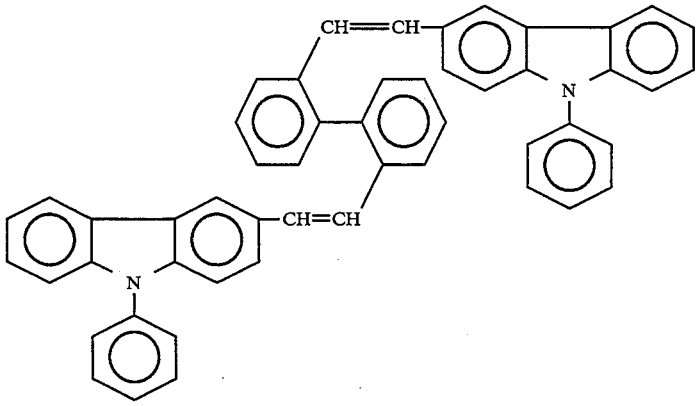
[II-18]
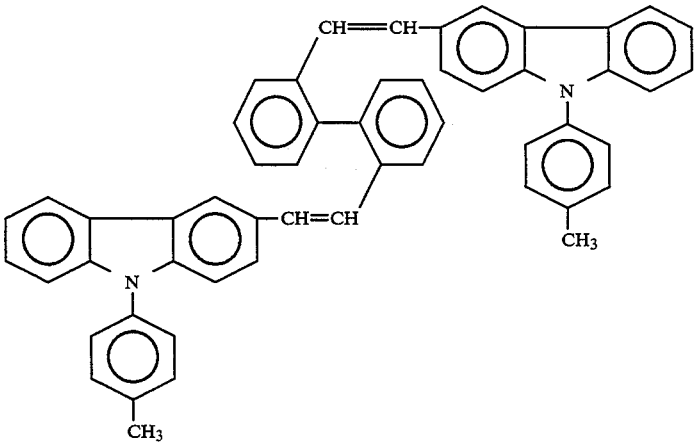

-continued
[II-19]
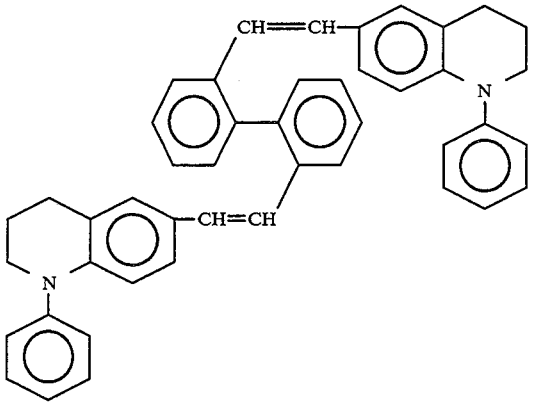
[II-20]
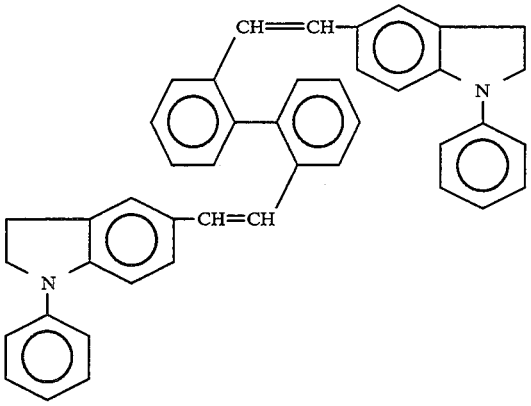
[II-21]
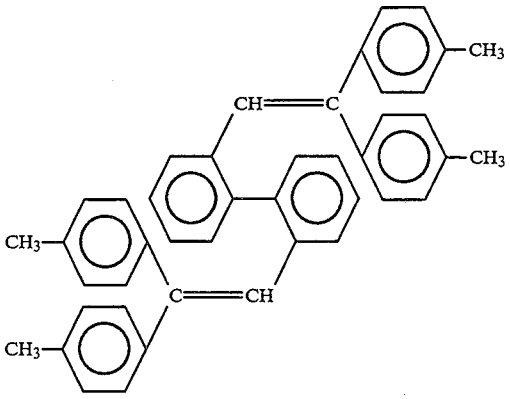
[II-22]
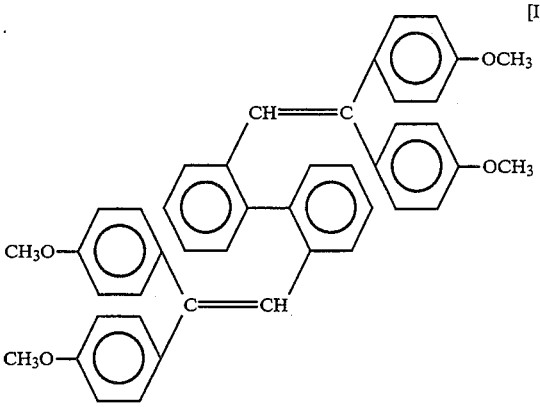
[II-23]
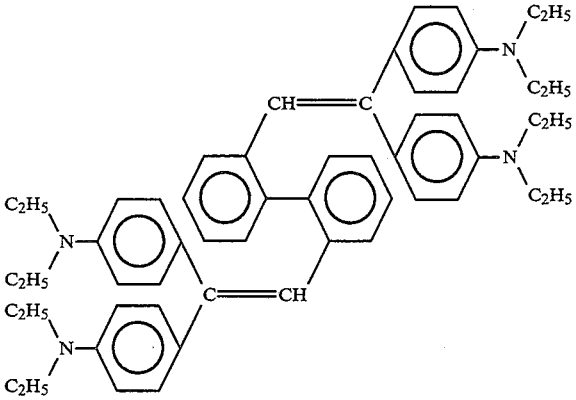
[II-24]
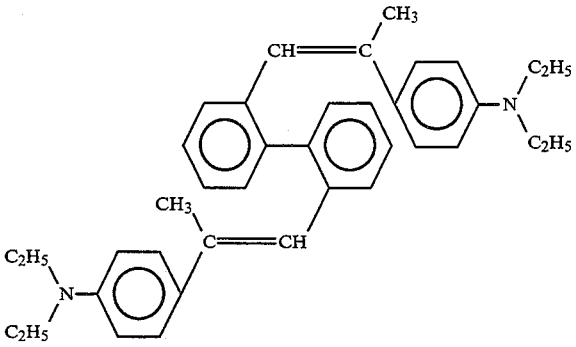

-continued
[II-25]
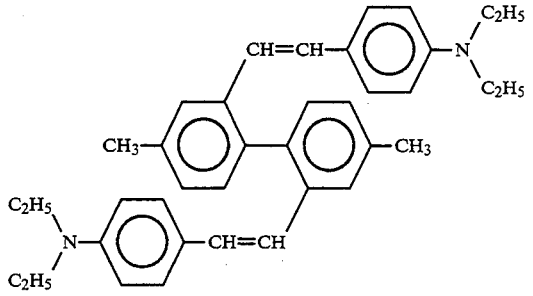
[II-26]
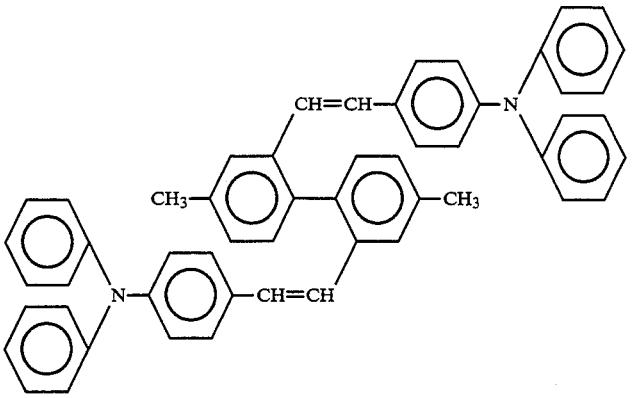
[II-27]
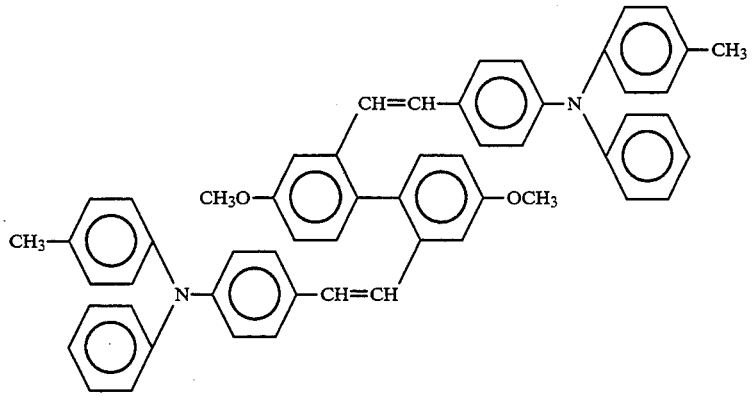
[II-28]
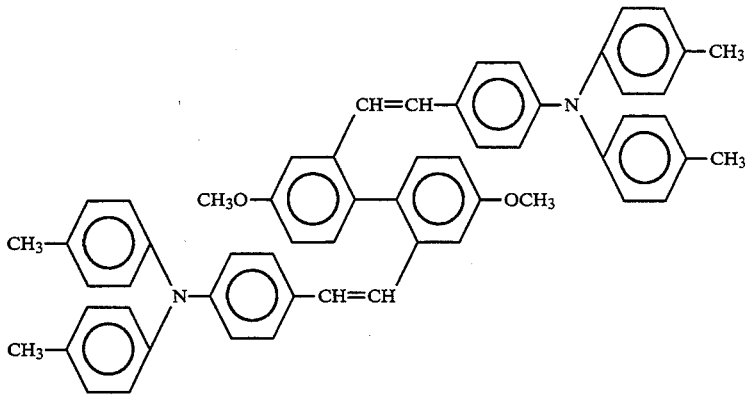

-continued
[II-29]
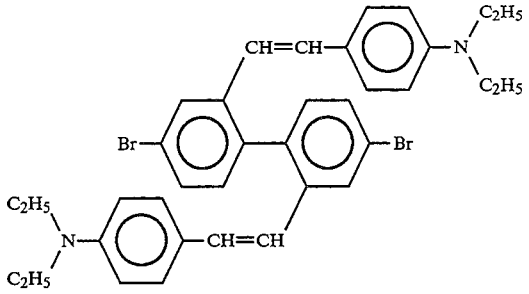
[II-30]
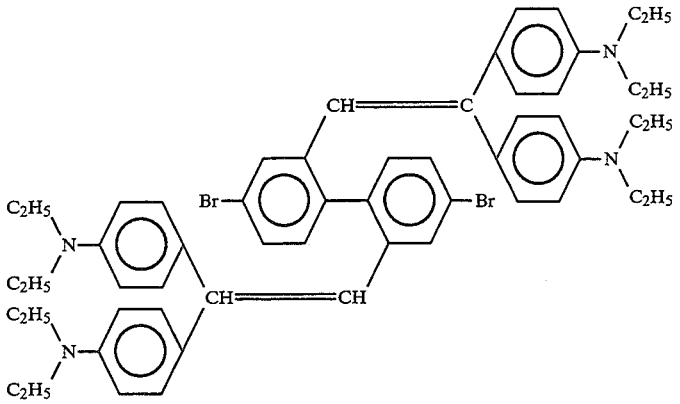
[II-31]
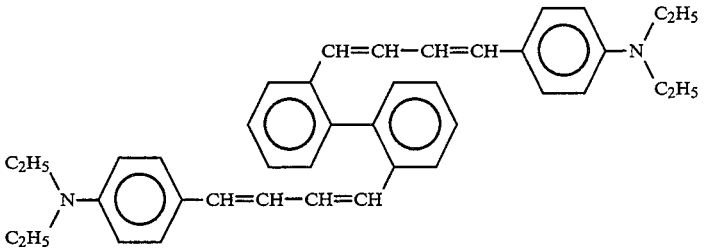
[II-32]
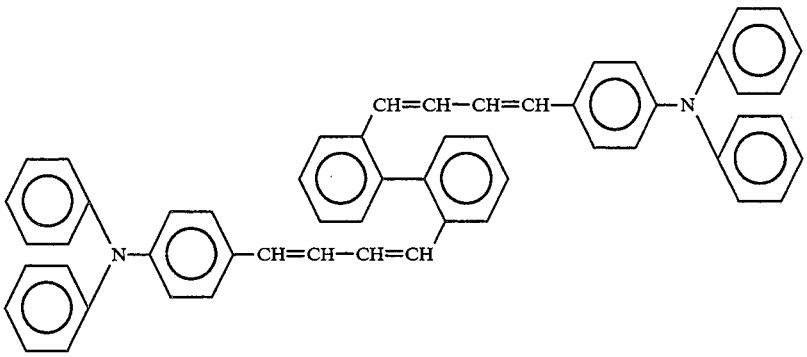

-continued
[II-33]
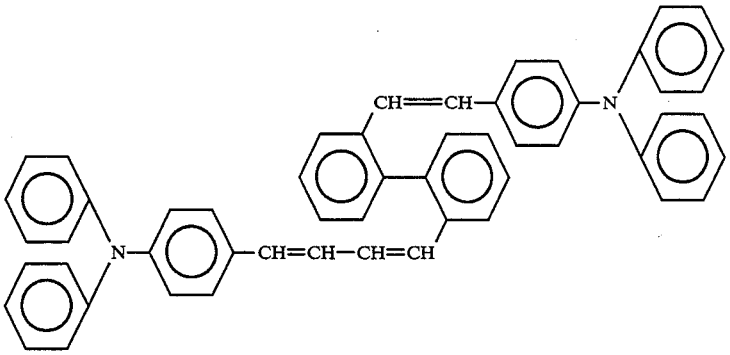
[II-34]
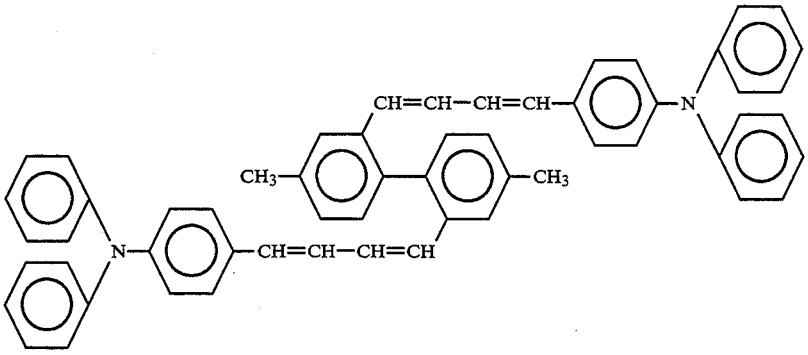
[II-35]
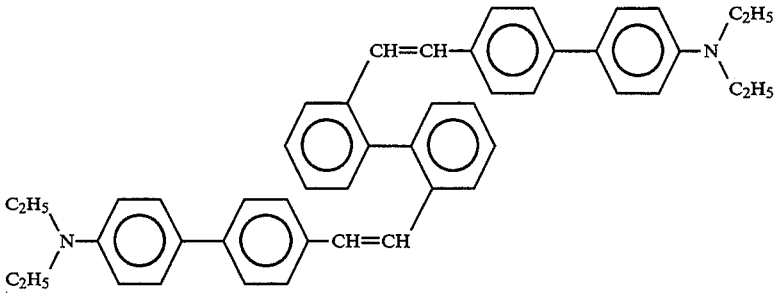
[II-36]
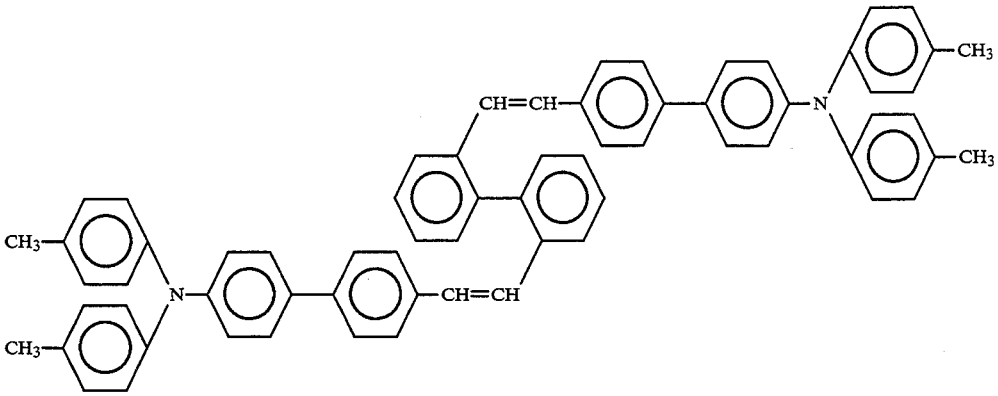
Among those compounds, [II-2], [II-4], [II-5], [II-6], [II-7], [II-8], [II-9], [II-11], [II-15], [II-18], [II-19], [II-23], [II-27], [II-32], [II-33] and [II-36] are particularly preferred.
A distyryl compound represented by the general formula [II] can be prepared as follows;
For example, a phosphorus compound represented by the following formula [XII]:
[XII]
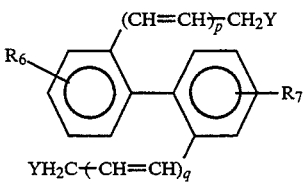

in which $R_6$, $R_7$, p and q are the same as those in the formula [II]; Y is trialkyl or triaryl phosphonium salt represented by $-P^+(R_{10})_3Z^-$ (Z represents a halogen atom; $R_{10}$ represents an alkyl group or an aryl group), or dialkyl or diaryl phosphite salt represented by $PO(OR_{11})_2$ ($R_{11}$ is an alkyl group or an aryl group), is treated for condensation with ketone compounds represented by the following general formulas [XIII] and [XIV]:

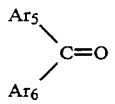
[XIII]

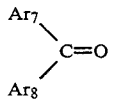
[XIV]

in which $Ar_5$ to $Ar_8$ are the same as those in the formula [II].

The phosphorus compound represented by the formula [XII] can be prepared easily by treating the corresponding compounds with trialkyl phosphite directly or in a solvent such as toluene and xylene while heating. An alkyl group of C1–C4, particularly a methyl group and a ethyl group are preferable for the trialkyl phosphite.

The phosphorus compound represented by the formula [XII] obtained as above mentioned is treated with the aldehyde compound represented by the general formula [XIII] in the presence of a basic catalyst at a temperature within the range between room temperature and 100° C.

A solvent used in the above reaction is exemplified by hydrocarbons, alcohols and ethers, in particular, methanol, ethanol, isopropyl alcohol, butanol, 2-methoxyethanol, 1,2-dimethoxyethane, bis(2-methoxyethyl)ether, dioxane, tetrahydrofuran, toluene, xylene, dimethylsulfoxide, N,N-dimethylformamide, N-methylpyrrolidone or 1,3-dimethyl-2-imidazolidinone. Among these solvents a polar solvent such as N,N-dimethylformamide and dimethylsulfoxide are particularly preferred.

A basic catalyst (a condensation agent) is exemplified by sodium hydroxide, potassium hydroxide, sodium amide, hydrogen sodium and a alcoholate such as sodium methoxide, potassium t-butoxide.

The reaction may be carried out in a wide range of temperature between about 0° C. to about 100° C., preferably about 10° C. to about 80° C.

The obtained distyryl compounds may be used singly or in mixture, or in combination with other charge transporting material such as hydrazone compounds.

A styryl compound represented by the general formula [I] or [II] is excellent in photosensitivity and charge transportability and very useful as a photoconductive material, in particular as a charge transporting material.

The distyryl compound represented by the general formula [I] or [II] may be applied to a photosensitive member as a photosensitive material and is particularly useful as a charge transporting material. The distyryl compound may be applied to a charge transporting layer of an electroluminescence device by taking advantage of its charge transportability.

First, it is explained hereinafter that the distyryl compound represented by the general formula [I] or [II] is applied as a charge transporting material for a photosensitive member.

A photosensitive member of the present invention has a photosensitive layer containing one or more distyryl compound represented by the general formula [I] or [II].

There are known various forms of photosensitive member. The distyryl compound of the present invention may be applied to any form of photosensitive member. For example, there is known a monolayer type in which a photosensitive layer containing a charge generating material and a charge transporting material dispersed in a binder resin is formed on an electrically conductive substrate and a laminated type in which a charge generating layer containing a charge generating material as a main material is formed on a substrate, followed by formation of a charge transporting layer on the charge generating layer. One or more of the distyryl compounds of the present invention are used as a charge transporting material.

The distyryl compound works as a charge transporting material in a photosensitive member and is able to carry very effectively electrical charges given by charge generating materials by light-absorption.

In particular, the distyryl compound of the present invention contributes to the improvement of charge mobility and can give a photosensitive member having high response speed.

The distyryl compound of the present invention is excellent in stability to light and ozone resistance. Therefore, a photosensitive member excellent in repetition durability can be obtained.

Moreover, the distyryl compound of the present invention has good compatibility with a binder resin, resulting in rare deposition of crystals and contribution to improvement of sensitivity and repetition properties. A charge generating material useful for the present photosensitive member is exemplified by organic substances such as bisazo dyes, triarylmethane dyes, thiazine dyes, oxazine dyes, xanthene dyes, cyanine coloring agents, styryl coloring agents, pyrylium dyes, azo pigments, quinacridone pigments, indigo pigments, perylene pigments, polycyclic quinone pigments, bisbenzimidazole pigments, indanthrone pigments, squalylium pigments, azulene coloring agents and phthalocyanine pigments; and inorganic substances such as selenium, selenium-tellurium, selenium arsenic, cadmium sulfide, cadmium selenide, zinc oxide and amorphous silicon. Any other material is also usable insofar as it generates charge carriers very efficiently upon absorption of light.

The binder resins used for forming a photosensitive layer are exemplified with no significance in restricting the embodiments of the invention by thermoplastic resins such as saturated polyesters, polyamides, acrylic resins, ethylene-vinyl acetate copolymers, ion cross-linked olefin copolymers (ionomer), styrene-butadiene block copolymers, polycarbonates, vinyl chloride-vinyl acetate copolymers, cellulose esters, polyimides and styrols; thermosetting resins such as epoxy resins, urethane resins, silicone resins, phenolic resins, melamine resins, xylene resins, alkyd resins and thermosetting acrylic resins; photocuring resins; and photoconductive resins such as polyvinylcarbazole, polyvinylpyrene, polyvinylanthracene, polyvinylpyrrole, all named without any significance of restricting the use of them. Any of these resins can be used singly or in combination with other resins. It is desirable for any of these electrically insulating resins to have a volume resistance of $1\times10^{12}$ Ωcm or more when measured singly.

In order to form a photosensitive member of a monolayer type, fine particles of a charge generating material are dispersed in a resin solution or a solution containing a charge transporting material and a binder resin and then the solution is sprayed on an electrically conductive substrate followed by drying. A thickness of the photosensitive layer is 3–30 μm, preferably 5–20 μm. The sensitivity becomes poor if the charge generating material is used in an insufficient quantity, whereas the chargeability becomes poor and the mechanical strength of photosensitive layer is inadequate if used to excess. Therefore, the amount of the charge generating material is within the range of 0.01–2 parts by weight, preferably 0.2–1.2 parts by weight on the basis of one part by weight of the binder resin of the photosensitive layer. The amount of distyryl compound of the formula [I] or [II] as a charge transporting material is within the range of 0.01–2 pares by weight, preferably 0.1–1.5 parts by weight, more preferably 0.2–1.2 parts by weight on the basis of one part by weight of the binder resin. If the amount is less than 0.01 part by weight, sensitivity becomes poor. If the amount is more than 2 parts by weight, layer forming properties and mechanical strength of the photosensitive layer become poor.

In order to form a photosensitive member of a laminated type, a charge generating material is deposited in a vacuum on an electrically conductive substrate, a charge generating material is dissolved in an adequate solvent to apply onto an electrically conductive substrate or an application solution containing a charge transporting material and, if necessary, a binder resin dissolved in an appropriate solvent is applied onto an electrically conductive substrate to be dried, for the formation of a charge generating layer on an electrically substrate. Then, a solution containing a charge transporting material and a binder resin is applied onto the charge generating layer followed by drying for the formation of a charge transporting layer. A thickness of the charge generating layer is 4 μm or less, preferably 2 μm or less. A thickness of the charge transporting layer is 3–50 μm, preferably 5–30 μm. A ratio of the charge transporting material in the charge transporting layer is 0.2–2 parts by weight, preferably 0.3–1.3 parts by weight on the basis of one part by weight of the binder resin.

A photosensitive member of the present invention permits, in combination with the binder, the use of a plasticizer such as halogenated paraffin, polybiphenyl chloride, dimethyl naphthalene, dibutyl phthalate and o-terphenyl, the use of an electron-attracting sensitizer such as chloranyl, tetracyanoethylene, 2,4,7-trinitrofluorenone, 5,6-dicyanobenzoquinone, tetracyanoquinodimethane, tetrachlorophthalic anhydride and 3,5-dinitrobenzoic acid, or the use of a sensitizer such as methyl violet, rhodamine B, cyanine dye, pyrylium salt and thiapyrylium salt.

An electrically conductive substrate is exemplified by a sheet or a drum made of metal or alloy such as copper, aluminum, silver, iron and nickel; a substrate such as a plastic film on which the foregoing metal or alloy is adhered by a vacuum-deposition method or an electroless plating method and the like; substrate such as a plastic film and paper on which an electro-conductive layer is formed by applying or depositing electroconductive polymer, indium oxide, tin oxide etc.

Concrete constitutions of a photosensitive member are shown in FIG. 1 to FIG. 5.

FIG. 1 shows a monolayer type in which a photosensitive layer (4) containing a charge generating material (3) and a charge transporting material (2) dispersed in a binder resin is formed on an electrically conductive substrate. The distyryl compound of the present invention is used as the charge transporting material.

Figure 2:
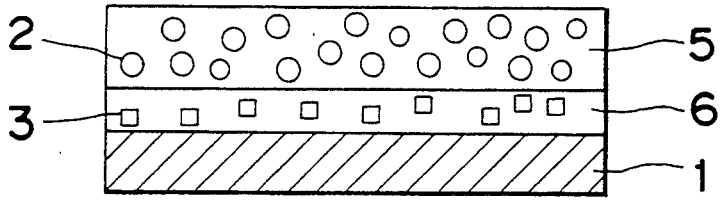
FIG. 2 is a schematic sectional view of a function-divided photosensitive member having a charge generating layer and a charge transporting layer on an electrically conductive substrate in this order.

FIG. 2 is a function-divided type in which a photosensitive layer is composed of a charge generating layer (6) and a charge transporting layer (5). The charge transporting layer (6) is formed on the surface of the charge generating layer (5). The distyryl compound of the present invention is incorporated into the charge transporting layer (5).

Figure 3:
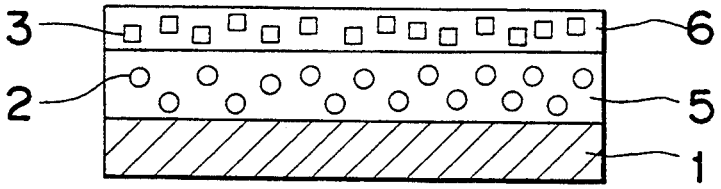
FIG. 3 is a schematic sectional view of a function-divided photosensitive member having a charge transporting layer and a charge generating layer on an electrically conductive substrate in this order.

A photosensitive member shown in FIG. 3 is similar to that of FIG. 2 in a function divided type having a charge generating layer (6) and a charge transporting layer (5), but different in that the charge generating layer (6) is formed on the surface of the charge transporting layer (5).

Figure 4:
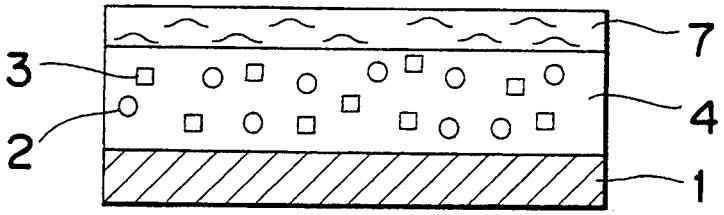
FIG. 4 is a schematic sectional view of a photosensitive member having a photosensitive layer and a surface protective layer on an electrically conductive substrate in this order.
Figure 5:
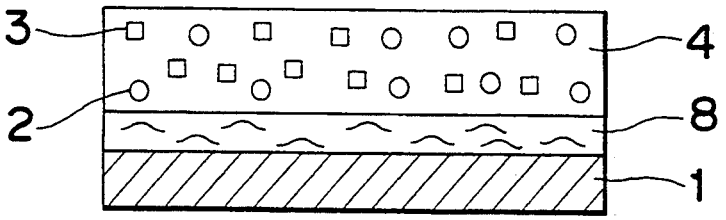
FIG. 5 is a schematic sectional view of a photosensitive member having an intermediate layer and a photosensitive layer on an electrically conductive substrate in this order.

A photosensitive member shown in FIG. 4 has further a surface protective layer (4) formed on the photosensitive member of FIG. 1. The photosensitive layer (4) may be a function divided type having a charge generating layer (6) and a charge transporting layer (5). A photosensitive member shown in FIG. 5 has an intermediate layer between a substrate (1) and a photosensitive layer (4). The intermediate layer is effective in improvement of adhesivity, improvement of coatability, protection of the substrate, improvement of charge injection from the substrate into the photosensitive layer.

Materials used for the formation of the intermediate layer is exemplified by polyimides, polyamides, nitrocelluloses, polyvinyl butyrals, polyvinyl alcohols and aluminum oxide. It is desirable that a thickness of the intermediate layer is 1 μm or less.

A distyryl compound of the present invention represented by the general formula [I] or [II] can be applied to a charge transporting layer of an electroluminescent device by taking advantage of its charge transporting properties. The application of the distyryl compound of the present invention to an electroluminescent device is explained hereinafter.

An electroluminescent device is composed of at least an organic luminous layer and a charge transporting layer between electrodes.

Figure 6:
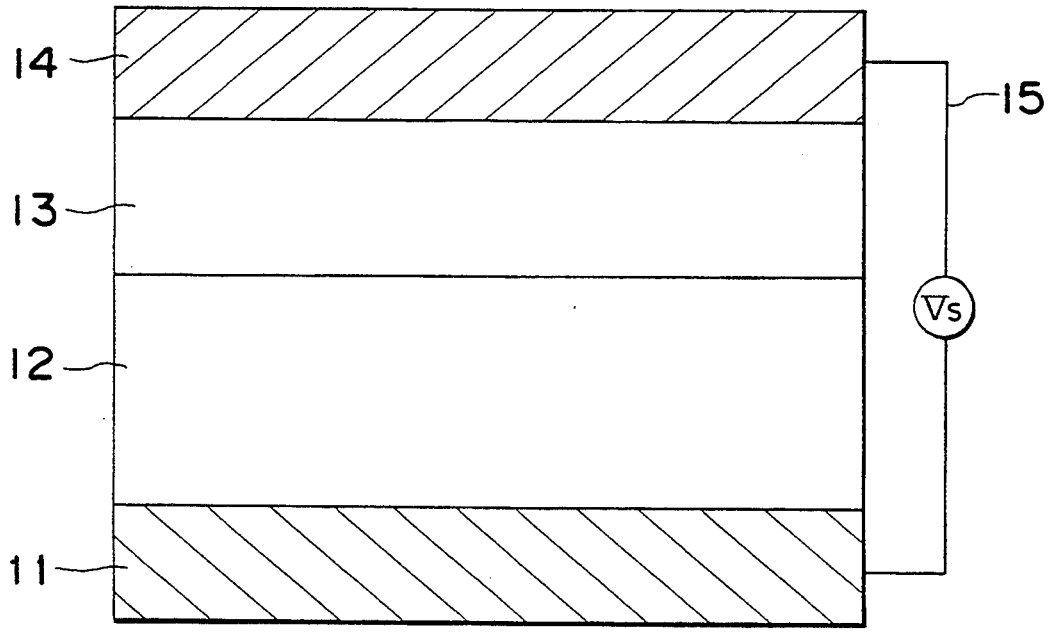
FIG. 6 is a schematic sectional view of an electroluminescence device.

A sectional schematic view of an electroluminescent device is shown in FIG. 6. In the figure, the reference number (11) is an anode, on which a charge transporting layer (12), an organic luminous layer (13) and a cathode (14) are laminated in the order. A distyryl compound of the present invention represented by the general formula [I] or [II] is contained in the charge transporting layer.

A voltage is applied between the anode (11) and the cathode (14) to give luminescence.

As to an electrically conductive material used as the anode (11) of the organic electroluminescent device, the ones having work function of 4 eV or more are preferable and exemplified by carbon, aluminum, vanadium, ferrite, cobalt, nickel, copper, zinc, tungsten, silver, tin, gold, alloy thereof, tin oxide and indium oxide.

As to an electrically conductive material used as the cathode (14) of the organic electroluminescent device, the ones having working function of 4 eV or less and exemplified by magnesium, calcium, titanium, yttrium, lithium, gadolinium, ytterbium, ruthenium, manganese and an alloy thereof.

In the organic electroluminescent device, at least one of the anode (11) or the cathode (14) is made transparent so that luminescence can be seen. A transparent electrode is formed by depositing or sputtering electroconductive materials above mentioned on a transparent substrate to give a desired transparency.

The transparent substrate is not particularly limited so far as it has an adequate strength and is not influenced adversely by heat generated in deposition process during the preparation of an electroluminescence device. Such a transparent material is exemplified by a glass substrate, transparent resin such as polyethylene, polypropylene, poly-ether-sulfone, poly-ether-ether-ketone.

A transparent electrode available in the market such as ITO and NESA are known in which a transparent electrode is formed on a glass substrate.

The charge transporting layer (12) may be formed by depositing a distyryl compound represented by the general formula [I] or [II] or spin-coating an adequate solution or resin-solution of the distyryl compound.

When the charge transporting layer (12) is formed by a deposition method, its thickness is 0.01–0.3 μm in general. When the charge transporting layer (12) is formed by a spin-coating method, its thickness is 0.05–1.0 μm and the distyryl compound is incorporated at a content of 20–500% by weight on the basis of a binder resin.

Then, an organic luminous layer is formed on the charge transporting layer (12).

As to organic luminous materials incorporated in the organic luminous layer, the ones known can be used and exemplified by epitolidine, 2,5-bis[5,7-di-t-pentyl-2-benzoxazolyl]thiophene, 2,2'-(1,4-phenylenedivinylene)bisbenzothiazole, 2,2'-(4,4'-biphenylene)bisbenzothiazole, 5-methyl-2-{2-[4-(5-methyl-2-benzoxazolyl)phenyl] vinyl}benzoxazole, 2,5-bis(5-methyl-2-benzoxazolyl)thiophene, anthracene, naphthalene, phenanthrene, pyrene, chrysene, perylene, perylenequinone, 1,4-diphenylbutadiene, tetraphenylbutadiene, coumarin, acridine stilbene, 2-(4-biphenyl)-6-phenylbenzoxazole, aluminum trioxine, magnesium bisoxine, zinc bis(benzo-8-qunolinol), bis(2-methyl-8-qunolinolate)aluminum oxide, indium trisoxine, aluminum tris(5-methyloxine), lithium oxine, gallium trioxine, calcium bis(5-chloroxine), poly-zinc-bis(8-hydroxy-5-qunolinyl)methane), dilithium epindridione, zinc bisoxine, 1,2-phthaloperynone and 1,2-naphthaloperynone. Further, general fluorescent dyes such as fluorescent coumarin dyes, fluorescent perylene dyes, fluorescent pyran dyes, fluorescent thiopyran dyes, fluorescent polymethine dyes, fluorescent merocyanine dyes and fluorescent imidazole dyes. Particularly preferable ones are chelated oxinoides.

The organic luminous layer may be a monolayer type formed with the above mentioned luminous compounds or may be a multilayer type in order to adjust color of luminescence, strength of luminescence and the like.

Finally, a cathode is formed on the organic luminous layer, so that an organic luminescent device in which the charge transporting layer(12), the luminous layer (13) and the cathode (14) are laminated on the anode(11) in the order is obtained. The luminous layer (13) and the charge transporting layer may be formed on the cathode (13) in the order.

A pair of transparent electrodes are bonded to an adequate lead wire such as nichrome wire, gold wire, copper wire and platinum wire and a voltage is applied to the electrodes so that luminant light may be given.

An organic electroluminescence device can be applied to various kinds of display devices.

Specific examples are shown below. In the examples, the wording "part(s)" means "part(s) by weight" so far as it is not explained particularly.

SYNTHETIC EXAMPLE I-1

Synthetic Example of the distyryl compound [I-23]

4-methyltriphenylamine carboaldehyde of 5.47 g and the phosphonate compound represented by the following formula:

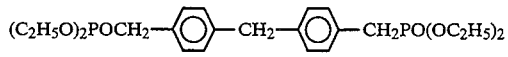

of 47 g were dissolved in dimethylformamide of 100 ml. While the obtained solution was cooled at 5° C. or less, the suspension solution containing potassium t-butoxide of 3 g in dimethylformamide of 150 ml was added to the solution. The obtained mixture was stirred for 8 hours at room temperature and left to stand for 8 hour.

Figure 7:
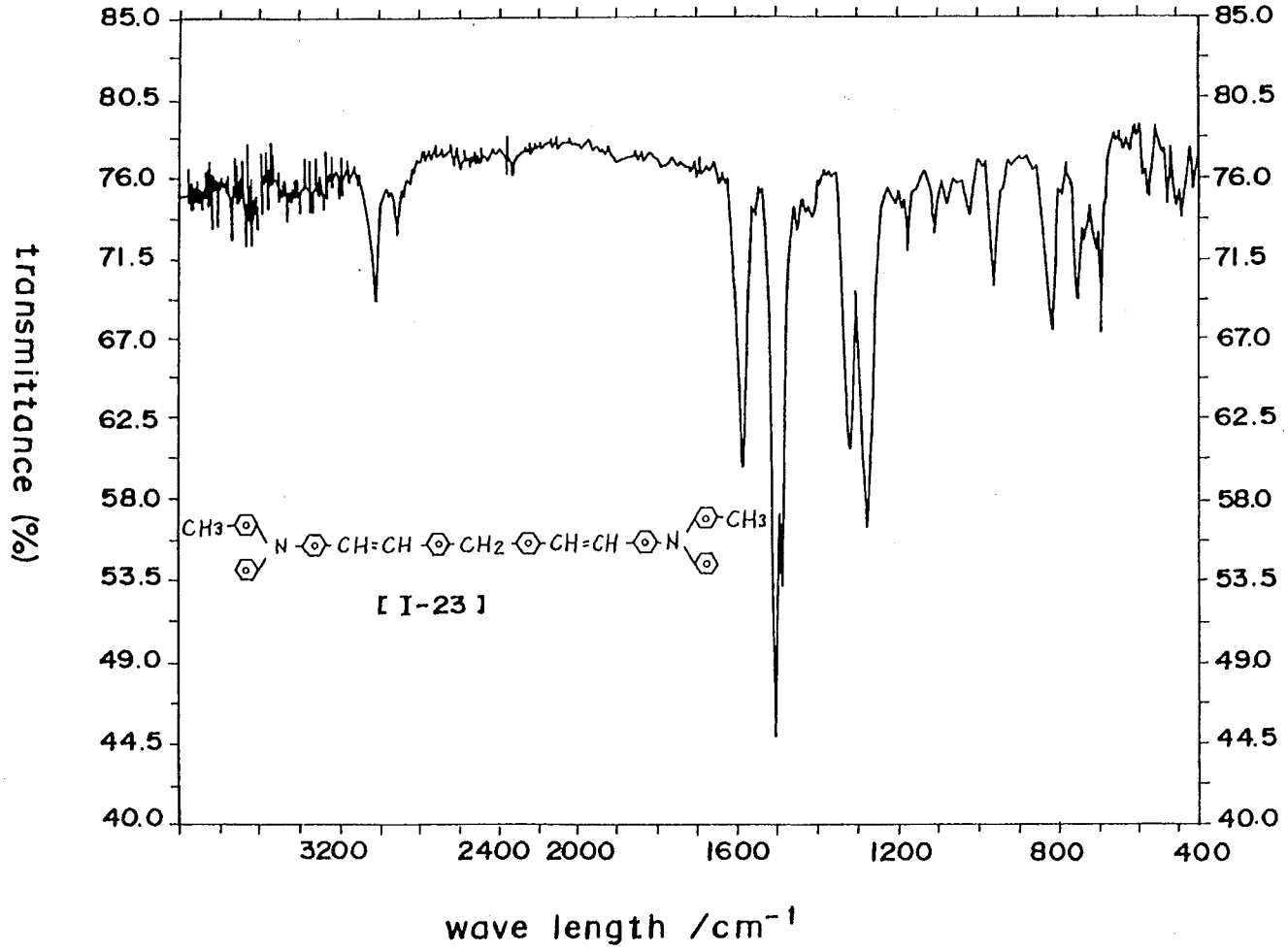
FIG. 7 shows Infrared absorption spectrum of distyryl compound [I-23].

The mixture was poured into ice water of 900 ml and then neutralized with dilute hydrochloric acid. After about 1 hour, the separated crystals were filtrated, washed with water and purified by means of silica gel column chromatography. The purified products were purified by recrystallization to give pale-yellow crystals of 5.6 g (yield of 76%). The Infrared spectrum of the products is shown FIG. 7. The result of elemental analysis ($C_{55}H_{46}N_2$) is shown in Table I-1 below.

TABLE I-1

| | C(%) | H(%) | N(%) |
|---|---|---|---|
| calculated | 89.92 | 6.27 | 3.81 |
| found | 89.89 | 6.22 | 3.78 |

SYNTHETIC EXAMPLE II-1

Synthetic Example of the distyryl compound [II-5]

The aldehyde compound represented by the following formula [a]:

[a]

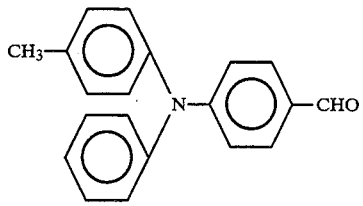

of 5.74 g and the phosphonate compound represented by the following formula [b]:

[b]

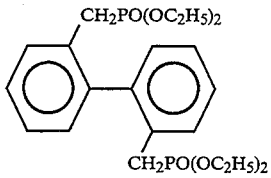

of 4.54 g were dissolved in dimethylformamide of 100 ml. While the obtained solution was cooled at 5° C. or less, the solution was added into the suspension solution containing potassium t-butoxide of 3 g in dimethylformamide of 100. The obtained mixture was stirred for 8 hours at room temperature and left to stand overnight.

Figure 8:
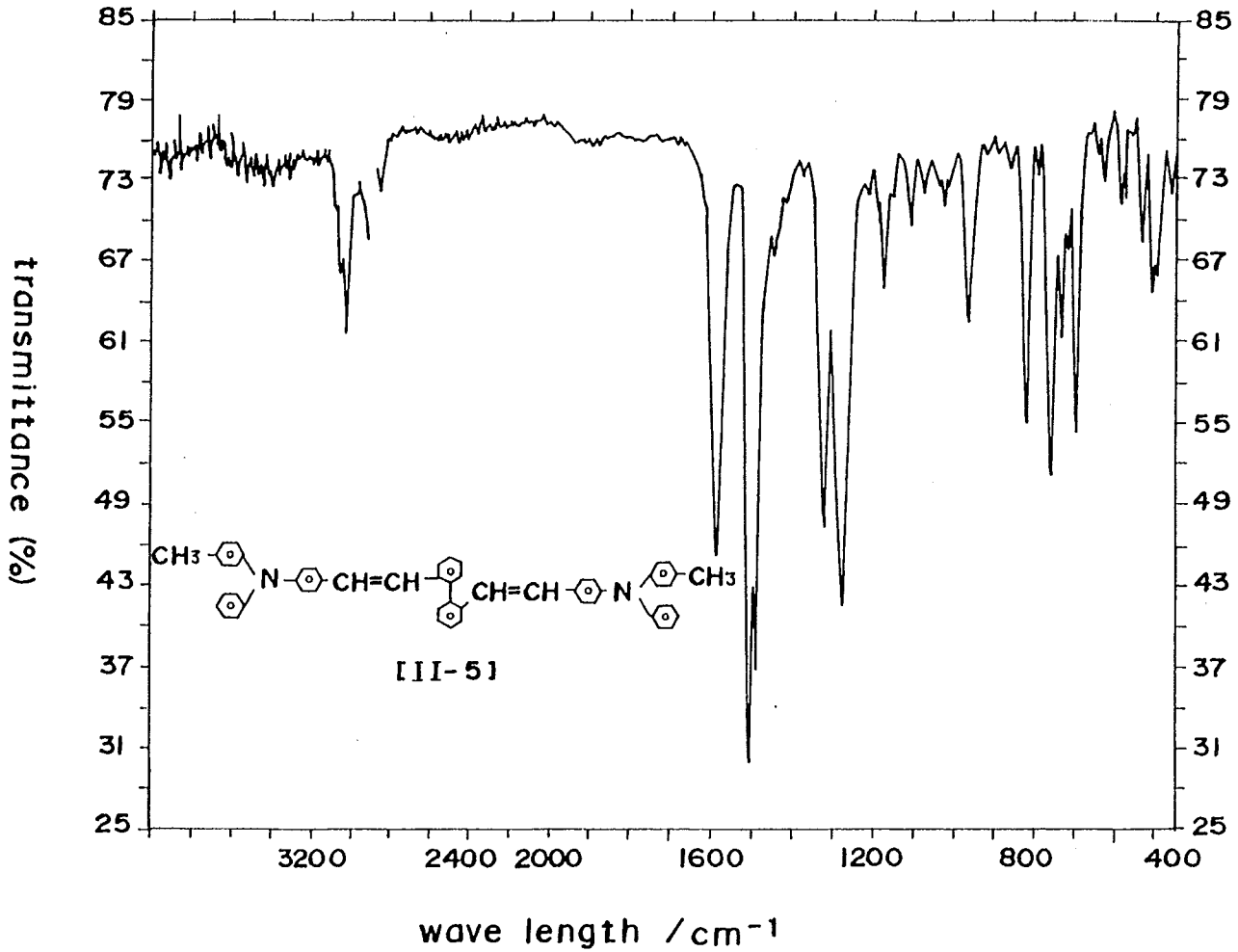
FIG. 8 shows Infrared absorption spectrum of distyryl compound [II-5].

The mixture was poured into ice water of 1 liter and then neutralized with dilute hydrochloric acid. After about 1 hour, the separated crystals were filtrated, washed with water and purified by means of silica gel column chromatography using toluene. Toluene was removed in vacuum to give residue. The residue was purified by recrystallization in acetonitrile to give yellow crystals of 5.3 g (yield of 74%). The Infrared spectrum of the products is shown FIG. 8. The result of elemental analysis ($C_{54}H_{44}N_2$) is shown in Table II-1 below.

TABLE II-1

| | C(%) | H(%) | N(%) |
|---|---|---|---|
| calculated | 90.00 | 6.11 | 3.89 |
| found | 89.97 | 6.06 | 3.80 |

Figure 9:
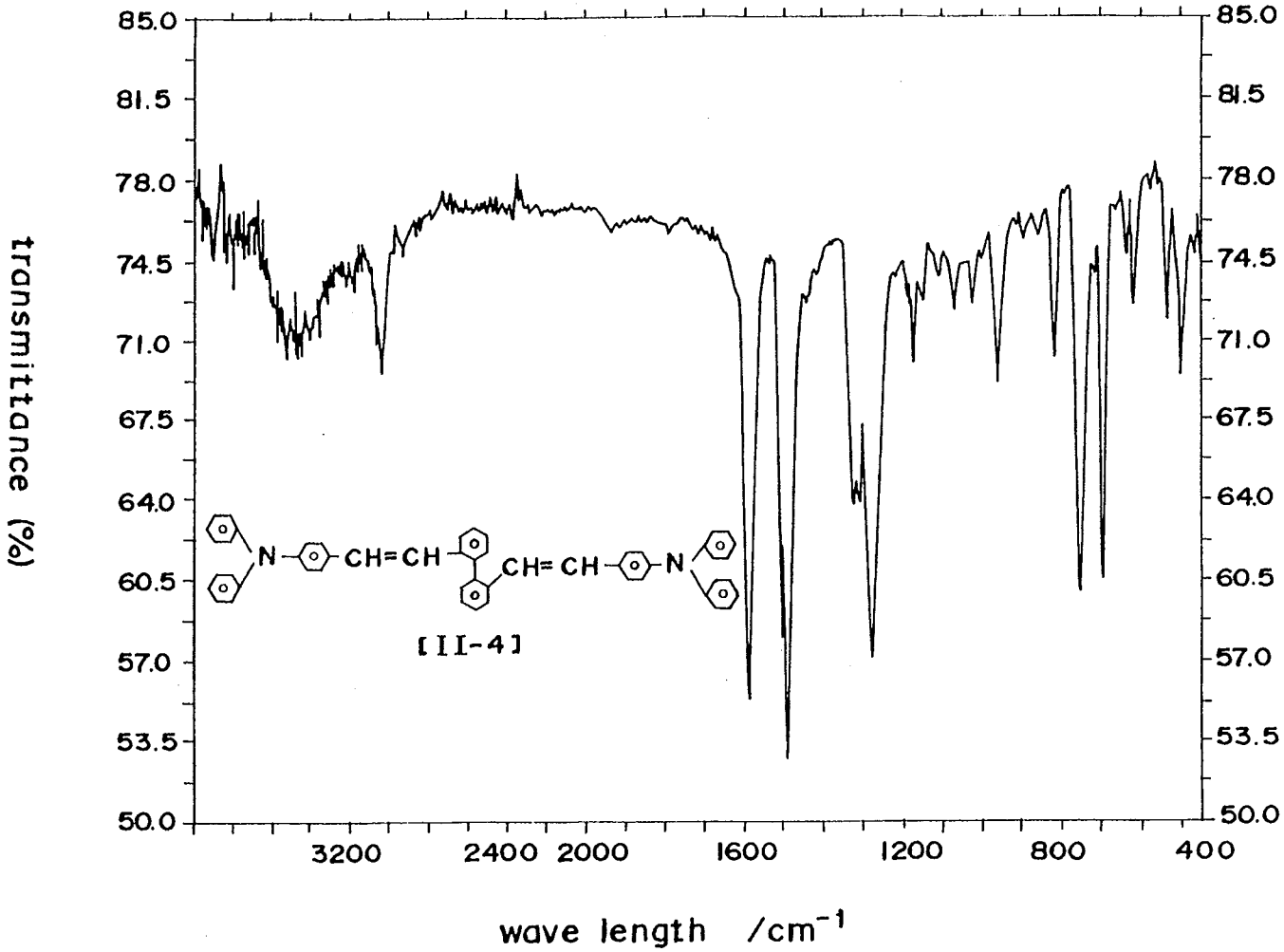
FIG. 9 shows Infrared absorption spetrum of distyryl compound [II-4].

The obtained mixture was poured into ice water of 1 liter and then neutralized with dilute hydrochloric acid. After about 1 hour, the separated crystals were filtrated, washed with water and purified by means of silica gel column chromatography using toluene. Toluene was removed in vacuo to give residue. The residue was purified by recrystallization in acetonitrile to give yellow crystals of 5.4 g (yield of 78%). The Infrared spectrum of the products is shown FIG. 9. The result of elemental analysis ($C_{52}H_{40}N_2$) is shown in Table II-2 below.

TABLE II-2

| | C(%) | H(%) | N(%) |
|---|---|---|---|
| calculated | 90.17 | 5.78 | 4.05 |
| found | 90.14 | 5.69 | 4.00 |

EXAMPLE I-1

The bisazo compound (0.45 parts) represented by the general formula [A] below:

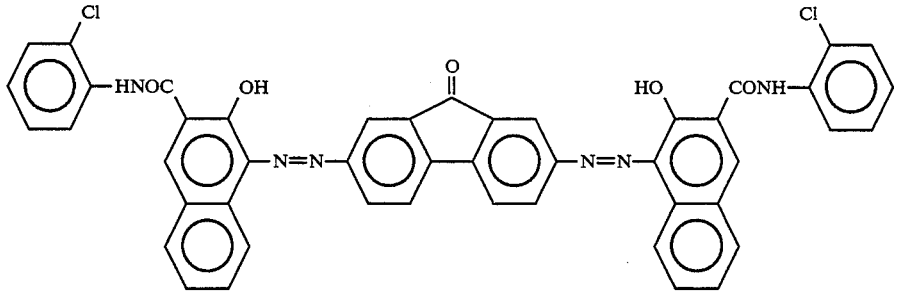

[A]

SYNTHETIC EXAMPLE II-2

Synthetic Example of the distyryl compound [II-4]

The aldehyde compound represented by the following formula [c]:

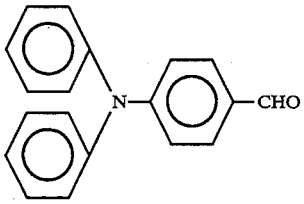

[c]

of 5.46 g and the phosphonate compound represented by the following formula [b]:

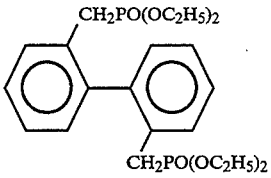

[b]

of 4.54 g were dissolved in dimethylformamide of 100 ml. While the obtained solution was cooled at 5° C. or less, the solution was added into the suspension solution containing sodium ethylate of 2 g in dimethylformamide of 100 ml for 30 minutes. The obtained solution was stirred for 5 hours at room temperature and left to stand overnight.

polyester resin (Vylon 200; made by Toyobo K.K.) of 0.45 parts and cyclohexanone of 50 parts were placed in Sand mill for dispersion. The dispersion solution of the bisazo compound was applied onto aluminotype-Mylar of 100 micron thickness by film applicator to form a charge generating layer so that the thickness of dried layer would be 0.3 g/m$^2$.

A solution containing the distyryl compound [I-2] of 50 parts and polycarbonate resin (Panlite K-1300, made by Teijin Kasei K.K.) of 50 parts dissolved in 1,4-dioxane of 400 parts was applied onto the charge generating layer to form a charge transporting layer so that the thickness of dried layer would be 16 microns. Thus, a photosensitive member with two layers was prepared.

The resultant photosensitive member was installed in a copying machine (EP-470Z; made by Minolta Camera K.K.) and corona-charged by power of −6 KV level to evaluate initial surface potential $V_0$ (V), half-reducing amount ($E_{\frac{1}{2}}$ (lux.sec)) and dark decreasing ratio of the initial surface potential ($DDR_1$). $E_{\frac{1}{2}}$ means an exposure amount required to reduce the initial surface potential to half the value. $DDR_1$ is a decreasing ratio of the initial surface potential after the photosensitive member was left for 1 second in the dark.

EXAMPLES I-2–I-4

Photosensitive members were prepared in a manner similar to Example I-1 except that the distyryl compounds [I-3], [I-4] and [I-5] were used respectively instead of the distyryl compound [I-2].

$V_0$, $E_{\frac{1}{2}}$and $DDR_1$ were evaluated on the obtained photosensitive members in a manner similar to Example I-1.

EXAMPLE I-5

The bisazo compound (0.45 parts) represented by the general formula [B] below:

[B]

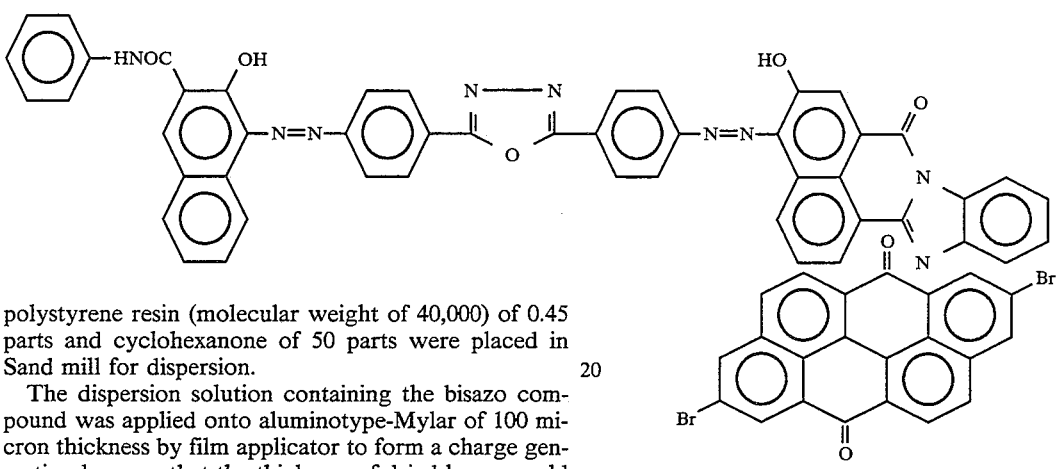

polystyrene resin (molecular weight of 40,000) of 0.45 parts and cyclohexanone of 50 parts were placed in Sand mill for dispersion.

The dispersion solution containing the bisazo compound was applied onto aluminotype-Mylar of 100 micron thickness by film applicator to form a charge generating layer so that the thickness of dried layer would be 0.3 g/m$^2$.

A solution containing the distyryl compound [I-7] of 50 parts and polyarylate resin (U-100; made by Yunichica K.K.) of 50 parts dissolved in 1,4-dioxane of 400 parts was applied onto the charge generating layer to form a charge transporting layer so that the thickness of dried layer would be 20 microns. Thus, a photosensitive member with two layers was prepared.

$V_0$, $E_{\frac{1}{2}}$ and $DDR_1$ were evaluated on the obtained photosensitive member in a manner similar to Example I-1.

EXAMPLES I-6–I-8

Photosensitive members were prepared in a manner similar to Example I-5 except that the distyryl compounds [I-8], [I-9] and [I-10] were respectively used instead of the distyryl compound [I-7].

$V_0$, $E_{\frac{1}{2}}$ and $DDR_1$ were evaluated on the obtained photosensitive members in a manner similar to Example I-1.

EXAMPLE I-9

The polycyclic quinone compound (0.45 parts) represented by the general formula [C] below:

[C]

polycarbonate resin (Panlite K-1300; made by Teijin Kasei K.K.) of 0.45 parts and dicloroethane of 50 parts were placed in Sand mill for dispersion.

The dispersion solution of the polycyclic quinone pigments was applied onto aluminotype-Mylar of 100 micron thickness by film applicator to form a charge generating layer so that the thickness of dried layer would be 0.4 g/m$^2$.

A solution containing of the distyryl compound [I-12] of 60 parts and polyarylate resin (U-100; made by Yunichica K.K.) of 50 parts dissolved in 1,4-dioxane of 400 parts was applied onto the charge generating layer to form a charge transporting layer so that the thickness of dried layer would be 18 microns. Thus, a photosensitive member with two layers was prepared.

$V_0$, $E_{\frac{1}{2}}$ and $DDR_1$ were evaluated on the obtained photosensitive member in a manner similar to Example I-1.

EXAMPLES I-10–I-11

Photosensitive members were prepared in a manner similar to Example I-9 except that the distyryl compounds [I-13] and [I-14] were respectively used instead of the distyryl compound [I-12].

$V_0$, $E_{\frac{1}{2}}$ and $DDR_1$ were evaluated on the obtained photosensitive members in a manner similar to Example I-1.

EXAMPLE I-12

The perylene pigments (0.45 parts) represented by the general formula [D] below:

[D]

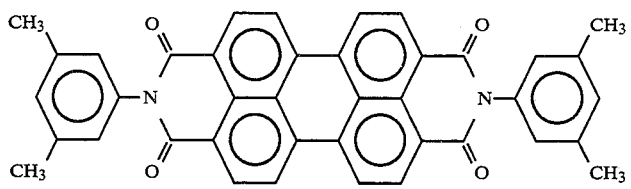

butyral resin (BX-1; made by Sekisui Kagaku Kogyo K.K.) of 0.45 parts and dicloroethane of 50 parts were placed in Sand mill for dispersion.

The dispersion solution of the perylene pigment was applied onto aluminotype-Mylar of 100 micron thickness by film applicator to form a charge generating layer so that the thickness of dried layer would be 0.4 g/m$^2$.

A solution containing the distyryl compound [I-15] of 50 parts and polycarbonate resin (PC-Z; made by Mitsubishi Gas Kagaku K.K.) of 50 parts dissolved in 1,4-dioxane of 400 parts was applied onto the charge generating layer to form a charge transporting layer so that the thickness of dried layer would be 18 microns. Thus, a photosensitive member with two layers was prepared.

$V_0$, $E_{\frac{1}{2}}$ and $DDR_1$ were evaluated on the obtained photosensitive member in a manner similar to Example I-1.

EXAMPLES 1-13–1-14

Photosensitive members were prepared in a manner similar to Example I-12 except that the distyryl compounds [I-19] and [I-20] were used respectively instead of the distyryl compound [I-15].

$V_0$, $E_{\frac{1}{2}}$ and $DDR_1$ were evaluated on the obtained photosensitive members in a manner similar to Example I-1.

EXAMPLE 1-15

Titanylphthalocyanine of 0.45 parts, butyral resin (BX-1; made by Sekisui Kagaku Kogyo K.K.) of 0.45 parts and dicloroethane of 50 parts were placed in Sand mill for dispersion.

The dispersion solution of the phthalocyanine pigment was applied onto aluminotype-Mylar of 100 micron thickness by film applicator to form a charge generating layer so that the thickness of dried layer would be 0.3 g/m$^2$.

A solution containing the distyryl compound [I-23] of 50 parts and polycarbonate resin (PC-Z; made by Mitsubishi Gas Kagaku K.K.) of 50 parts dissolved in 1,4-dioxane of 400 parts was applied onto the charge generating layer to form a charge transporting layer so that the thickness of dried layer would be 18 microns. Thus, a photosensitive member with two layers was prepared.

$V_0$, $E_{\frac{1}{2}}$ and $DDR_1$ were evaluated on the obtained photosensitive member in a manner similar to Example I-1.

EXAMPLES 1-16 and 1-17

Photosensitive members were prepared in a manner similar to Example I-15 except that the distyryl compounds [I-24] and [I-25] were used respectively instead of the distyryl compound [I-23].

$V_0$, $E_{\frac{1}{2}}$ and $DDR_1$ were evaluated on the obtained photosensitive member in a manner similar to Example I-1.

EXAMPLE I-18

Copper phthalocyanine of 50 parts and tetranitro-copper phthalocyanine of 0.2 parts were dissolved in 98% conc. sulfuric acid of 500 parts with stirring. The solution was poured into water of 5000 parts to deposit a photoconductive composition of copper phthalocyanine and tetranitro-copper phthalocyanine. The obtained composition was filtered, washed and dried at 120° C. under vacuum conditions.

The photoconductive composition obtained above of 10 parts, thermosetting acrylic resin (Acrydick A405; made by Dainippon Ink K.K.) of 22.5 parts, melamine resin (Super Beckamine J820; made by Dainippon Ink K.K.) of 7.5 parts, the distyryl compound [I-30] of 15 parts and mixed solution of methyl ethyl ketone and xylene (1:1) of 100 parts were placed in a ball mill pot for dispersion. The mixture was mixed for dispersion for 48 hours to give a photosensitive application solution. The application solution is applied onto an aluminum substrate and dried. Thus, a photosensitive layer having thickness of about 15 microns was formed.

$V_0$, $E_{\frac{1}{2}}$ and $DDR_1$ were evaluated on the obtained photosensitive member in a manner similar to Example I-1 except that the photosensitive member was corona-charged by power of +6 KV level.

EXAMPLES I-19–I-21

Photosensitive members were prepared in a manner similar to Example I-18 except that the distyryl compounds [I-33], [I-34] and [I-35] were respectively used instead of the distyryl compound [I-30].

$V_0$, $E_{\frac{1}{2}}$ and $DDR_1$ were evaluated on the obtained photosensitive members in a manner similar to Example I-18.

EXAMPLE I-22

The trisazo compound (0.45 parts) represented by the general formula [E] below:

[E]

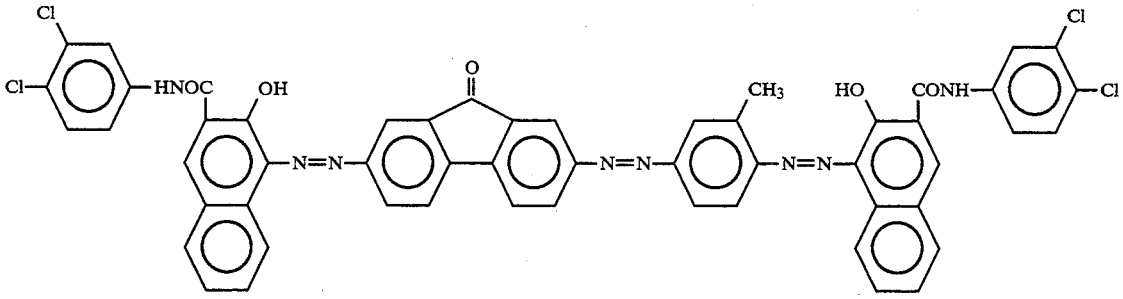

butyral resin (BX-1; made by Sekisui Kagaku K.K.) of 0.25 parts, phenoxy resin (pkHH; made by Union Carbide K.K.) and cyclohexanone of 50 parts were placed in Sand mill for dispersion. The dispersion solution was applied onto an aluminum drum by a dipping method to form a charge generating layer so that the thickness of dried layer would be 0.2 μm.

A solution containing the distyryl compound [I-42] of 50 parts and polycarbonate resin (Z-300; made by Mitsubishi Gas Kagaku K.K.) of 50 parts dissolved in tetrahydrofuran of 400 pares was applied onto the charge generating layer to form a charge transporting layer so that the thickness of dried layer would be 23 microns. Thus, a photosensitive member with two layers was prepared.

$V_0$, $E_{\frac{1}{2}}$ and $DDR_1$ were evaluated on the obtained photosensitive member in a manner similar to Example I-1.

EXAMPLES I-23–I-25

Photosensitive members were prepared in a manner similar to Example I-22 except that the distyryl compounds [I-43], [I-46] and [I-50] were used respectively instead of the distyryl compound [I-42].

$V_0$, $E_{\frac{1}{2}}$ and $DDR_1$ were evaluated on the obtained photosensitive members in a manner similar to Example I-1.

EXAMPLES I-26–I-28

Photosensitive members were prepared in a manner similar to Example I-18 except that the distyryl compounds [I-51], [I-55] and [I-59] were used respectively instead of the distyryl compound [I-30].

$V_0$, $E_{\frac{1}{2}}$ and $DDR_1$ were evaluated on the obtained photosensitive members in a manner similar to Example I-18.

The results of $V_0$, $E_{\frac{1}{2}}$ and $DDR_1$ with respect to the photosensitive members obtained Examples I-1–I-28 were summarized in Table I-2 below.

TABLE I-2

| | $V_0$(V) | $E_{\frac{1}{2}}$ (lux · sec) | $DDR_1$(%) |
|---|---|---|---|
| Example I-1 | −650 | 1.8 | 2.8 |
| Example I-2 | −640 | 1.9 | 3.0 |
| Example I-3 | −640 | 1.6 | 3.3 |
| Example I-4 | −650 | 1.5 | 2.6 |
| Example I-5 | −640 | 1.9 | 3.5 |
| Example I-6 | −650 | 1.6 | 3.0 |
| Example I-7 | −640 | 1.7 | 3.7 |
| Example I-8 | −650 | 1.5 | 2.8 |
| Example I-9 | −660 | 1.8 | 2.5 |
| Example I-10 | −650 | 1.7 | 2.9 |
| Example I-11 | −650 | 1.6 | 2.8 |
| Example I-12 | −660 | 1.5 | 2.4 |
| Example I-13 | −650 | 1.8 | 3.0 |
| Example I-14 | −640 | 1.3 | 3.2 |
| Example I-15 | −650 | 1.7 | 2.8 |
| Example I-16 | −660 | 1.2 | 2.4 |
| Example I-17 | −650 | 1.5 | 2.9 |
| Example I-18 | +620 | 1.3 | 12.4 |
| Example I-19 | +610 | 1.2 | 13.2 |
| Example I-20 | +620 | 1.0 | 12.7 |
| Example I-21 | +620 | 1.3 | 12.5 |
| Example 1-22 | −650 | 1.6 | 2.7 |
| Example I-23 | −660 | 1.4 | 2.5 |
| Example I-24 | −650 | 1.3 | 2.9 |
| Example I-25 | −660 | 1.5 | 2.4 |
| Example I-26 | +620 | 1.1 | 12.0 |
| Example I-27 | +610 | 1.2 | 12.9 |
| Example I-28 | +620 | 1.4 | 12.3 |

Further, the photosensitive member of Example I-18 was installed into a copying machine (EP-350Z; made by Minolta Camera K.K.) to be subjected to positively charged repetition test. Even after 1000 times of copy, clear copy images excellent in gradation were formed both at initial stage and final stage through the test and the sensitivity was stable. Accordingly, the photosensitive members of the present invention were also excellent in repetition properties.

EXAMPLE II-1

The bisazo compound (0.45 parts) represented by the general formula [A] below:

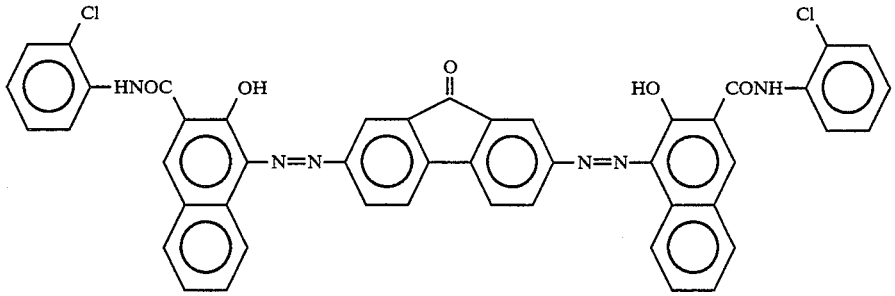

[A]

polyester resin (Vylon 200; made by Toyobo K.K.) of 0.45 parts and cyclohexanone of 50 parts were placed in Sand mill for dispersion. The dispersion solution of the bisazo compound was applied onto aluminotype-Mylar of 100 micron thickness by film applicator to form a charge generating layer so that the thickness of dried layer would be 0.3 g/m$^2$.

A solution containing the distyryl compound [II-2] of 50 parts and polycarbonate resin (Panlite K-1300, made by Teijin Kasei K.K.) of 50 parts dissolved in 1,4-dioxane of 400 parts was applied onto the charge generating layer to form a charge transporting layer so that the thickness of dried layer would be 16 microns. Thus, a photosensitive member with two layers was prepared.

The resultant photosensitive member was installed in a copying machine (EP-450Z; made by Minolta Camera K.K.) and corona-charged by power of −6 KV level to evaluate $V_0$, $E_{\frac{1}{2}}$ and $DDR_1$.

EXAMPLES II-2–II-4

Photosensitive members were prepared in a manner similar to Example II-1 except that the distyryl compounds [II-4], [II-5] and [II-6] were used respectively instead of the distyryl compound [II-2].

$V_0$, $E_{\frac{1}{2}}$ and $DDR_1$ were evaluated on the obtained photosensitive members in a manner similar to Example I-1.

EXAMPLE II-5

The bisazo compound (0.45 parts) represented by the general formula [B] below:

[B]

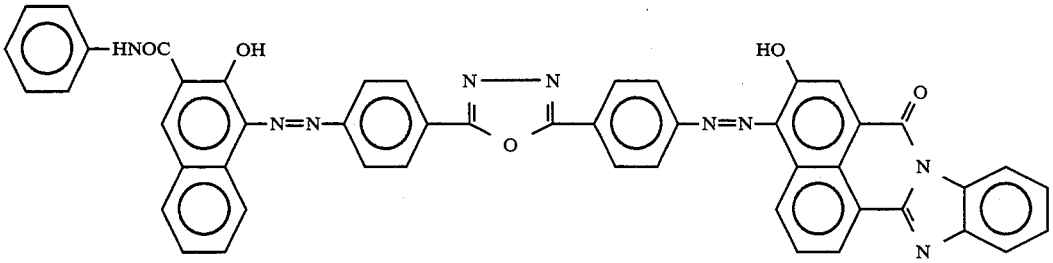

polystyrene resin (molecular weight of 40,000) of 0.45 parts and cyclohexanone of 50 parts were placed in Sand mill for dispersion.

The dispersion solution containing the bisazo compound was applied onto aluminotype-Mylar of 100 micron thickness by film applicator to form a charge generating layer so that the thickness of dried layer would be 0.3 g/m$^2$.

A solution containing the distyryl compound [II-7] of 50 parts and polyarylate resin (U-100; made by Yunichica K.K.) of 50 parts dissolved in 1,4-dioxane of 400 parts was applied onto the charge generating layer to form a charge transporting layer so that the thickness of dried layer would be 20 microns. Thus, a photosensitive member with two layers was prepared.

$V_0$, $E_{\frac{1}{2}}$ and $DDR_1$ were evaluated on the obtained photosensitive member in a manner similar to Example I-1.

EXAMPLES II-6–II-8

Photosensitive members were prepared in a manner similar to Example II-5 except that the distyryl compounds [II-8], [II-9] and [II-11] were respectively used instead of the distyryl compound [II-7].

$V_0$, $E_{\frac{1}{2}}$ and $DDR_1$ were evaluated on the obtained photosensitive members in a manner similar to Example I-1.

EXAMPLE II-9

The polycyclic quinone compound (0.45 parts) represented by the general formula [C] below:

[C]

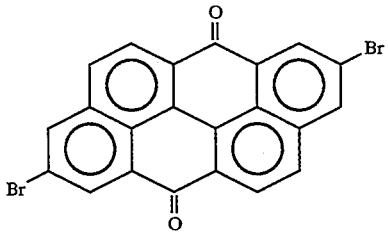

polycarbonate resin (Panlite K-1300; made by Teijin Kasei K.K. ) of 0.45 parts and dicloroethane of 50 parts were placed in Sand mill for dispersion.

The dispersion solution of the polycyclic quinone pigments was applied onto aluminotype-Mylar of 100 micron thickness by film applicator to form a charge generating layer so that the thickness of dried layer would be 0.4 g/m$^2$.

A solution containing of the distyryl compound [II-5] of 60 parts and polyarylate resin (U-100; made by Yunichica K.K. ) of 50 parts dissolved in 1,4-dioxane of 400 parts was applied onto the charge generating layer to form a charge transporting layer so that the thickness of dried layer would be 18 microns. Thus, a photosensitive member with two layers was prepared.

$V_0$, $E_{\frac{1}{2}}$ and $DDR_1$ were evaluated on the obtained photosensitive member in a manner similar to Example I-1.

EXAMPLES II-10–II-11

Photosensitive members were prepared in a manner similar to Example II-9 except that the distyryl compounds [II-18] and [II-19] were respectively used instead of the distyryl compound [II-15].

$V_0$, $E_{\frac{1}{2}}$ and $DDR_1$ were evaluated on the obtained photosensitive members in a manner similar to Example I-1.

EXAMPLE II-12

The perylene pigments (0.45 parts) represented by the general formula [D] below:

[D]

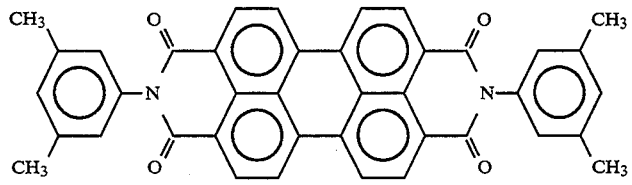

butyral resin (BX-1; made by Sekisui Kagaku Kogyo K.K.) of 0.45 parts and dicloroethane of 50 parts were placed in Sand mill for dispersion.

The dispersion solution of the perylene pigment was applied onto aluminotype-Mylar of 100 micron thickness by film applicator to form a charge generating layer so that the thickness of dried layer would be 0.4 g/m$^2$.

A solution containing the distyryl compound [II-23] of 50 parts and polycarbonate resin (PC-Z; made by Mitsubishi Gas Kagaku K.K.) of 50 parts dissolved in 1,4-dioxane of 400 parts was applied onto the charge generating layer to form a charge transporting layer so that the thickness of dried layer would be 18 microns. Thus, a photosensitive member with two layers was prepared.

$V_0$, $E_{\frac{1}{2}}$ and $DDR_1$ were evaluated on the obtained photosensitive member in a manner similar to Example I-1.

EXAMPLES II-13–II-14

Photosensitive members were prepared in a manner similar to Example II-12 except that the distyryl compounds [II-27] and [II-32] were used respectively instead of the distyryl compound [II-23].

$V_0$, $E_{\frac{1}{2}}$ and $DDR_1$ were evaluated on the obtained photosensitive members in a manner similar to Example I-1.

EXAMPLE II-15

Titanylphthalocyanine of 0.45 parts, butyral resin (BX-1; made by Sekisui Kagaku Kogyo K.K.) of 0.45 parts and dicloroethane of 50 parts were placed in Sand mill for dispersion.

The dispersion solution of the phthalocyanine pigment was applied onto aluminotype-Mylar of 100 micron thickness by film applicator to form a charge generating layer so that the thickness of dried layer would be 0.3 g/m$^2$.

A solution containing the distyryl compound [II-5] of 50 parts and polycarbonate resin (PC-Z; made by Mitsubishi Gas Kagaku K.K.) of 50 parts dissolved in 1,4-dioxane of 400 parts was applied onto the charge generating layer to form a charge transporting layer so that the thickness of dried layer would be 18 microns. Thus, a photosensitive member with two layers was prepared.

$V_0$, $E_{\frac{1}{2}}$ and $DDR_1$ were evaluated on the obtained photosensitive member in a manner similar to Example I-1.

EXAMPLES II-16 and II-17

Photosensitive members were prepared in a manner similar to Example II-15 except that the distyryl compounds [II-26] and [II-36] were used respectively instead of the distyryl compound [II-5].

$V_0$, $E_{\frac{1}{2}}$ and $DDR_1$ were evaluated on the obtained photosensitive member in a manner similar to Example I-1.

EXAMPLE II-18

Copper phthalocyanine of 50 parts and tetranitro-copper phthalocyanine of 0.2 parts were dissolved in 98% conc. sulfuric acid of 500 parts with stirring. The solution was poured into water of 5000 parts to deposit a photoconductive composition of copper phthalocyanine and tetranitro-copper phthalocyanine. The obtained composition was filtered, washed and dried at 120° C. under vacuum conditions.

The photoconductive composition obtained above of 10 parts, thermosetting acrylic resin (Acrydick A405; made by Dainippon Ink K.K.) of 22.5 parts, melamine resin (Super Beckamine J820; made by Dainippon Ink K.K.) of 7.5 parts, the distyryl compound [II-6] of 15 parts and mixed solution of methyl ethyl ketone and xylene (1:1) of 100 parts were placed in a ball mill pot for dispersion. The mixture was mixed for dispersion for 48 hours to give a photosensitive application solution. The application solution is applied onto an aluminum substrate and dried. Thus, a photosensitive layer having thickness of about 15 microns was formed.

$V_0$, $E_{\frac{1}{2}}$ and $DDR_1$ were evaluated on the obtained photosensitive member in a manner similar to Example I-1 except that the photosensitive member was corona-charged by power of +6 KV level.

EXAMPLES II-19–II-21

Photosensitive members were prepared in a manner similar to Example II-18 except that the distyryl compounds [II-9], [II-14] and [II-27] were respectively used instead of the distyryl compound [II-6].

$V_0$, $E_{\frac{1}{2}}$ and $DDR_1$ were evaluated on the obtained photosensitive members in a manner similar to Example II-18.

The results of $V_0$, $E_{\frac{1}{2}}$ and $DDR_1$ with respect to the photosensitive members obtained Examples II-1–II-21 were summarized in Table II-3 below.

TABLE II-3

| | $V_0$(V) | $E_{\frac{1}{2}}$ (lux · sec) | $DDR_1$(%) |
|---|---|---|---|
| Example II-1 | −660 | 1.4 | 2.4 |
| Example II-2 | −650 | 1.0 | 2.9 |
| Example II-3 | −660 | 0.8 | 2.5 |
| Example II-4 | −650 | 0.8 | 3.0 |
| Example II-5 | −650 | 0.7 | 3.1 |
| Example II-6 | −660 | 0.8 | 2.7 |
| Example II-7 | −670 | 0.7 | 2.1 |
| Example II-8 | −650 | 1.0 | 2.9 |
| Example II-9 | −660 | 1.3 | 2.4 |
| Example II-10 | −650 | 1.2 | 2.8 |
| Example II-11 | −650 | 1.5 | 3.1 |
| Example II-12 | −660 | 1.2 | 2.2 |
| Example II-13 | −650 | 0.9 | 2.7 |
| Example II-14 | −650 | 1.0 | 2.8 |
| Example II-15 | −660 | 0.8 | 2.3 |
| Example II-16 | −650 | 0.9 | 3.0 |
| Example II-17 | −650 | 0.8 | 3.1 |
| Example II-18 | +620 | 0.9 | 12.5 |
| Example II-19 | +620 | 0.7 | 12.3 |
| Example II-20 | +610 | 0.8 | 13.0 |
| Example II-21 | +610 | 0.6 | 13.4 |

COMPARATIVE EXAMPLES 1–4

Photosensitive members were prepared in a manner similar to Example I-18 except that the compounds represented by the formulas [F], [G], [H] and [I] were respectively used instead of the distyryl compound [I-30].

$V_0$, $E_{\frac{1}{2}}$ and $DDR_1$ were evaluated on the obtained photosensitive members in a manner similar to Example I-18.

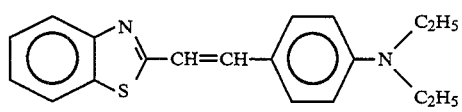

[F]

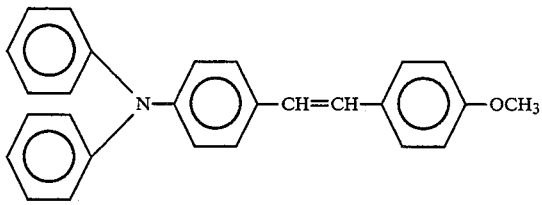

[G]

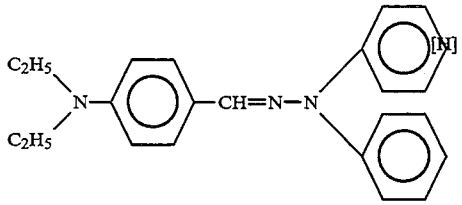

[H]

-continued

[I]

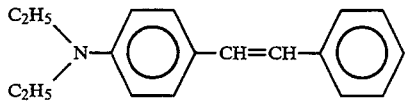

were respectively used instead of the distyryl compound [I-30].

$V_0$, $E_{\frac{1}{2}}$ and $DDR_1$ were evaluated on the obtained photosensitive members in a manner similar to Example I-18.

[J]

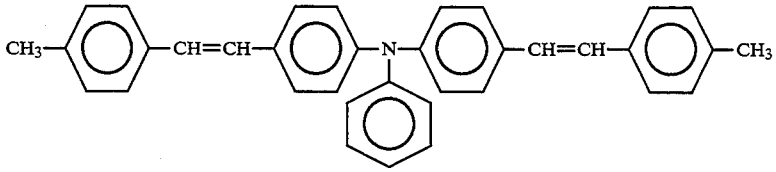

[K]

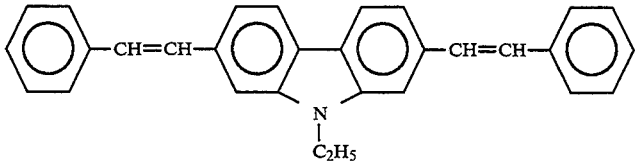

[L]

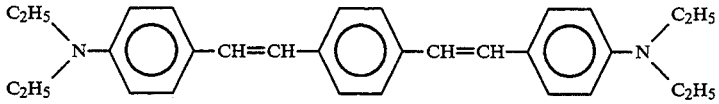

COMPARATIVE EXAMPLES 5-7

Photosensitive members were prepared in a manner similar to Example I-18 except that the compounds represented by the following formulas [J], [K] and [L]

COMPARATIVE EXAMPLES 8-11

Photosensitive members were prepared in a manner similar to Example I-18 except that the compounds represented by the following formulas [M], [N] [O] and [P] were respectively used instead of the distyryl compound [I-30].

[M]

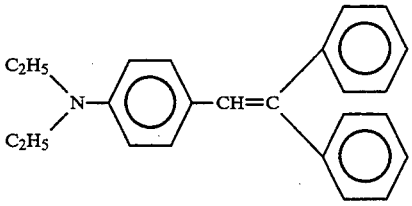

[N]

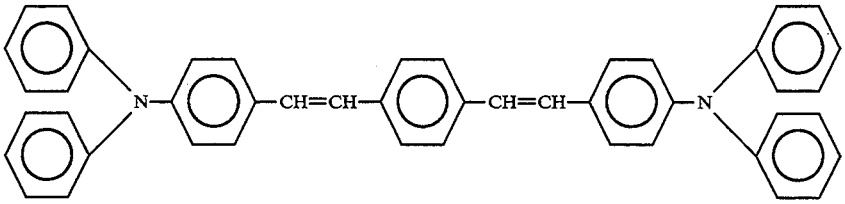

[O]

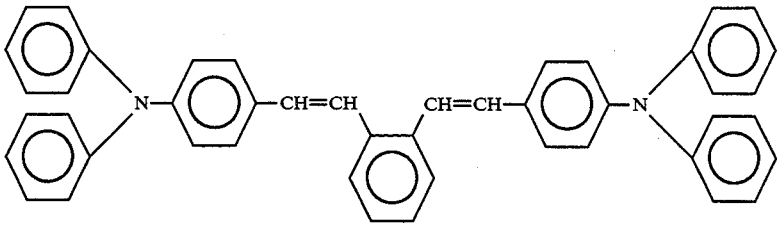

-continued

[P]

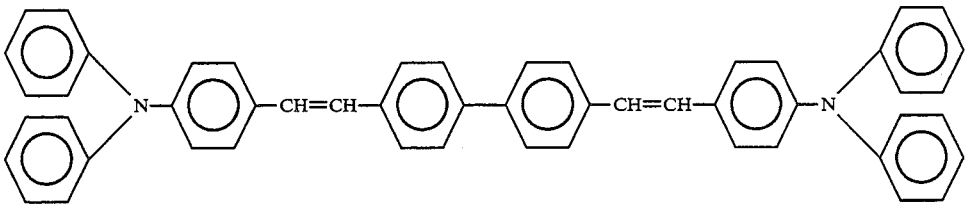

$V_0$, $E_{\frac{1}{2}}$ and $DDR_1$ were evaluated on the obtained photosensitive members in a manner similar to Example I-18.

In Comparative Examples 1–11, it was observed that some crystals were deposited partially when the photosensitive layers were formed with the use of photosensitive application solution containing the compounds of [H], [G], [J], [K], [L], [N] and [P].

The results of $V_0$, $E_{\frac{1}{2}}$ and $DDR_1$ with respect to the photosensitive members obtained Comparative Examples 1–11 were summarized in Table III below.

TABLE III

| | $V_0$(V) | $E_{\frac{1}{2}}$ (lux · sec) | $DDR_1$(%) |
|---|---|---|---|
| Comp. Example 1 | +620 | 15.0 | 12.0 |
| Comp. Example 2 | +600 | 6.5 | 13.7 |
| Comp. Example 3 | +600 | 3.2 | 14.3 |
| Comp. Example 4 | +610 | 10.2 | 11.5 |
| Comp. Example 5 | +620 | 3.0 | 12.4 |
| Comp. Example 6 | +630 | 4.5 | 12.5 |
| Comp. Example 7 | +620 | 7.4 | 13.5 |
| Comp. Example 8 | +610 | 5.8 | 11.6 |
| Comp. Example 9 | +620 | 13.4 | 9.8 |
| Comp. Example 10 | +620 | 6.0 | 11.3 |
| Comp. Example 11 | +610 | 3.2 | 12.4 |

It is understood from Table I-2, II-3 and III that the photosensitive members of the present invention, even though they are laminated types or monolayer-types, have sufficient charge keeping ability, low dark decreasing ratio such that the photosensitive members can be taken into practical use and excellent sensitivity.

Further, the photosensitive members of Example II-18, II-19 and Comparative Examples 10 and 11 were respectively installed into a copying machine (EP-350Z; made by Minolta Camera K.K.) to be subjected to positively charged repetition test of 10,000 times. $V_0$, $E_{\frac{1}{2}}$ and $DDR_1$ were evaluated to show the results in Table IV below.

TABLE IV

| | initial stage | | | after 10000 times | | |
|---|---|---|---|---|---|---|
| | $V_0$ (V) | $E_{\frac{1}{2}}$ (lux · sec) | $V_R$ (V) | $V_0$ (V) | $E_{\frac{1}{2}}$ (lux · sec) | $V_R$ (V) |
| EX.II-18 | 600 | 1.2 | 15 | 585 | 1.3 | 20 |
| EX.II-19 | 610 | 1.0 | 20 | 590 | 1.2 | 25 |
| Comp.EX.10 | 600 | 5.7 | 25 | 630 | 6.5 | 50 |
| Comp.EX.11 | 600 | 2.8 | 20 | 570 | 3.4 | 35 |

What is claimed is:

1. A photosensitive member having a photosensitive layer on an electrically conductive substrate, wherein the photosensitive layer comprises: a) a charge generating material and a charge transporting material dispersed in a binder resin or b) a charge generating layer containing a charge generating material and a charge transporting layer containing a charge transporting material;

wherein said charge transporting material comprises a distyryl compound represented by the following formula (I)

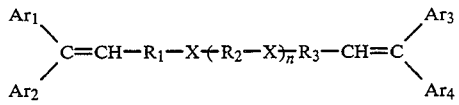

(I)

in which $Ar_1$, $Ar_2$, $Ar_3$ and $Ar_4$ represent respectively a hydrogen atom, an alkyl group, an aralkyl group, an aryl group, a biphenyl group or a heterocyclic group, each group may have a substituent;

$R_1$, $R_2$ and $R_3$ represent respectively an aralkylene group, an arylene group, a biphenylene group or a bivalent heterocyclic group; each of which may have a substituent;

X represents —O—, —S— or

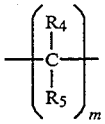

in which $R_4$ and $R_5$ represent respectively a hydrogen atom, an alkyl group or an aryl group; each group may have a substituent;

m is an integer of 1–5; and n is an integer of 0 or 1.

2. A photosensitive member of claim 1, in which the photosensitive layer has a thickness of 3–30 μm.

3. A photosensitive member of claim 2, in which the photosensitive layer contains the charge generating material at a content of 0.01 to 2 parts by weight on the basis of 1 part by weight of resin.

4. A photosensitive member of claim 1, in which the charge generating layer has a thickness of 4 μm or less.

5. A photosensitive member of claim 1, in which the charge transporting layer has a thickness of 3 to 50 μm.

6. A photosensitive member of claim 1, in which the charge transporting layer contains the distyryl compound at a content of 0.2 to 2 parts by weight on the basis of 1 part by weight of a binder resin.

7. A photosensitive member of claim 1, in which at least one of the $Ar_1$ to $Ar_4$ is a phenyl group or a biphenyl group, each of which may have a substituent.

8. A photosensitive member of claim 1, in which at least one of the $Ar_6$ and $Ar_8$ is an aryl group which may have a substituent.

9. A photosensitive member having a photosensitive layer on an electrically conductive substrate, wherein the photosensitive layer comprises: a charge generating material and a charge transporting material dispersed in a binder resin;

wherein said charge transporting material comprises a distyryl compound represented by the following formula (II)

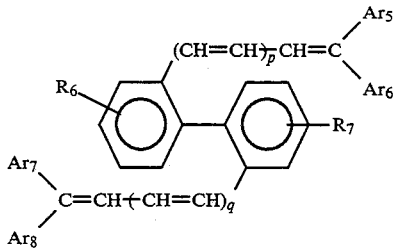

(II)

in which $Ar_5$ and $Ar_7$ represent respectively a hydrogen atom, an alkyl group or an aryl group which may have a substituent;

$Ar_6$ and $Ar_8$ represent respectively an aryl group, a fused ring group or a heterocyclic group, each of which may have a substituent;

$R_6$ and $R_7$ represent respectively a hydrogen atom, an alkyl group, an alkoxy group or a halogen atom; and p and q represent respectively an integer of 0 or 1.

10. A photosensitive member of claim 9, in which the photosensitive layer has a thickness of 3–30 μm.

11. A photosensitive member of claim 9, in which the photosensitive layer contains the charge generating material at a content of 0.01 to 2 parts by weight on the basis of 1 part by weight of resin.

12. A photosensitive member of claim 9, in which at least one of the $Ar_1$ to $Ar_4$ is a phenyl group or a biphenyl group, each of which may have a substituent.

13. A photosensitive member of claim 9, in which at least one of the $Ar_6$ and $Ar_8$ is an aryl group which may have a substituent.

* * * * *